US012674269B2

(12) United States Patent
Ludvigsen et al.

(10) Patent No.: US 12,674,269 B2
(45) Date of Patent: Jul. 7, 2026

(54) WASHING MACHINE DOOR ASSEMBLY

(71) Applicant: Eastman Chemical Company, Kingsport, TN (US)

(72) Inventors: Anders Thorsager Ludvigsen, Cincinnati, OH (US); Mark Elliott Tincher, Kingsport, TN (US); Allen Chase Williams, Erwin, TN (US)

(73) Assignee: Eastman Chemical Company, Kingsport, TN (US)

( * ) Notice: Subject to any disclaimer, the term of this patent is extended or adjusted under 35 U.S.C. 154(b) by 433 days.

(21) Appl. No.: 18/251,444

(22) PCT Filed: Nov. 9, 2021

(86) PCT No.: PCT/US2021/058517

§ 371 (c)(1),
(2) Date: May 2, 2023

(87) PCT Pub. No.: WO2022/099164

PCT Pub. Date: May 12, 2022

(65) Prior Publication Data

US 2024/0011217 A1 Jan. 11, 2024

Related U.S. Application Data

(60) Provisional application No. 63/111,236, filed on Nov. 9, 2020.

(51) Int. Cl.
*D06F 39/14* (2006.01)

(52) U.S. Cl.
CPC ..... *D06F 39/14* (2013.01)

(58) Field of Classification Search
CPC ..... D06F 39/14
USPC ..... 68/196
See application file for complete search history.

(56) References Cited

U.S. PATENT DOCUMENTS

| | | | | |
|---|---|---|---|---|
| 3,772,405 | A | 11/1973 | Hamb | |
| 5,654,347 | A | 8/1997 | Khemani et al. | |
| 5,696,176 | A | 12/1997 | Khemani et al. | |
| 6,748,771 | B2 | 6/2004 | Nitschmann et al. | |
| 2006/0287484 | A1 | 12/2006 | Crawford et al. | |
| 2019/0345313 | A1* | 11/2019 | Feng | C08L 1/10 |

FOREIGN PATENT DOCUMENTS

| | | | |
|---|---|---|---|
| DE | 1585607 | A1 | 5/1971 |
| DE | 10 2015 121176 | A1 | 6/2017 |
| EP | 2 243 874 | A1 | 4/2009 |

OTHER PUBLICATIONS

Eastman, Technical Data Sheet Eastman Tritan™ Copolyester TX1000, Jul. 15, 2020, Eastman, whole document (Year: 2020).*
ASTMD256; "Standard Test Methods for Determining the Izod Pendulum Impact Resistance of Plastics"; Published Mar. 2023.

(Continued)

*Primary Examiner* — Tinsae B Ayalew
(74) *Attorney, Agent, or Firm* — Robert C. Morriss

(57) ABSTRACT

A washing machine door assembly (100) is provided comprising a plastic bowl (102) fixedly engaged with an outer door frame (112) by one or more integral engagement features. The washing machine door assembly (100) does not include an inner door frame ring.

14 Claims, 8 Drawing Sheets

(56) References Cited

OTHER PUBLICATIONS

ASTMD638; "Standard Test Method for Tensile Properties of Plastics"; Published Jul. 2022.
ASTMD790; "Standard Test Methods for Flexural Properties of Unreinforced and Reinforced Plastics and Electrical Insulating Materials"; Published Jul. 2017.
ASTMD1003; "Standard Test Method for Haze and Luminous Transmittance of Transparent Plastics"; Published Jun. 2021.
ASTMD1925; "Standard Test Method for Yellowness Index of Plastics"; Published Mar. 1970.
ASTMD2463; "Standard Test Method for Drop Impact Resistance of Blow-Molded Thermoplastic Containers"; Published Apr. 2015.
ASTMD3418; "Standard Test Method for Transition Temperatures and Enthalpies of Fusion and Crystallization of Polymers by Differential Scanning Calorimetry"; Published Sep. 2021.
Notification of Transmittal of The International Search Report and The Written Opinion of the International Searching Authority, or the Declaration; International Application No. PCT/US2021/058517 with a Date of Mailing Feb. 9, 2022.

* cited by examiner

Detail A

WASHING MACHINE DOOR ASSEMBLY

CROSS-REFERENCE TO RELATED APPLICATION(S)

This application is a national stage filing under 35 USC § 371 of International Application Number PCT/US2021/058517, filed on, Nov. 9, 2021 which claims the benefit of the filing date to U.S. Provisional Application No. 63/111,236, filed on Nov. 9, 2020, the entire disclosures of which are incorporated by reference herein.

BACKGROUND

The present invention is directed to laundry treating appliances. More particularly, the present invention is directed to a door assembly for such appliances, such as a door assembly for front loading, horizontal axis clothes washers.

Laundry treating appliances, such as front-loading, horizontal axis clothes washers, typically have doors for accessing the treating chamber at least partially formed by a rotating drum. Such doors typically include a cast glass window to enable observation of a laundry load as the appliance is operated. In order to maintain the moving laundry load away from the door and within the treating chamber, the window may be cast from glass with a convex or "bubble" shape, called a fishbowl or washer bowl, extending away from the inner face of the door and somewhat into the treating chamber when the door is closed.

The thick, cast glass of a washer bowl is typically expensive to manufacture, heavy, and is not a structural component of the door assembly. Glass used for a washer bowl is manufactured at a thickness of greater than 5 mm to reduce the possibility of damage such as cracking. Even with increased thickness there is risk of the glass bowl breaking during shipping or during use, along with the associated safety issues. Typically, washer door construction uses a sandwiching style bowl mounting where the circumferential edge of the glass washer bowl is sandwiched between an outer (or front) door panel or ring and an inner (or rear) door ring. In this sandwich assembly, the bowl is not a structural element of the door and additional assembly steps are needed to attach it. The rear door ring screws to the front ring with a series of spaced screws pinching the bowl in place.

Accordingly, there is a need for a washer door assembly that reduces weight and is easy to assemble, yet still exhibit the desired characteristics of current washer doors.

SUMMARY

One embodiment of this invention is directed to a washing machine door assembly comprising, consisting of or, consisting essentially of an outer door frame including an opening defined by a ring-shaped member with an outer circumferential surface extending into the interior of the washer, and a bowl having an open end and a closed end defining an inside and an outside of the bowl and a ring-shaped inner circumferential surface on the inside of the bowl adjacent to and disposed around the perimeter of the open end of the bowl. The inner circumferential surface of the bowl is fixedly engaged with the outer circumferential surface of the ring-shaped member of the outer door frame by one or more engagement features configured for fixedly engaging said circumferential surfaces. Preferably, the one or more engagement features is or are integrally formed with the bowl and the door frame. The bowl comprises, consists of, or consists essentially of a first plastic composition that comprises a copolyester. The outer door frame comprises, consists of, or consists essentially of a second plastic composition that is the same or different than the first plastic composition.

In embodiments, the copolyester comprises, consists of, or consists essentially of a dicarboxylic acid component and a glycol component, wherein said dicarboxylic acid component comprises at least 70 mole percent of terephthalic acid residues, wherein said glycol component comprises, consists of, or consists essentially of at least 10 mole percent and not more than 80 mole percent of 2,2,4,4-tetramethyl-1,3-cyclobutanediol, and wherein said glycol component comprises, consists of, or consists essentially of at least 20 mole percent and not more than 90 mole percent of 1,4-cyclohexanedimethanol. In embodiments, the second plastic composition comprises, consists of, or consists essentially of an acrylonitrile butadiene styrene (ABS) thermoplastic polymer or a polypropylene. In one embodiment, the second plastic composition is an ABS thermoplastic polymer.

In embodiments, the inner circumferential surface of the bowl and the outer circumferential surface of the ring-shaped member of the outer door frame are fixedly engaged by one or more engagement features known in the art, such as screws, nuts, and bolts. Preferred engagement features comprise, consist of, or consists essentially of at least one pair of mating engagement components, wherein one of the components of the pair is integrally-formed in said bowl and the other component of the pair is integrally-formed in said ring-shaped member. In embodiments, the inner circumferential surface of the bowl and the outer circumferential surface of the ring-shaped member are releasably fixedly engaged. In one embodiment, the pair of mating engagement components are configured to make a twist-lock connection.

In embodiments, the inner circumferential surface of the bowl and the outer circumferential surface of the ring-shaped member of the outer door frame are permanently fixedly engaged by a welded interface connection. In one embodiment, the welded interface connection is formed by dual-shot injection molding.

In embodiments, the washing machine door assembly further comprises an inner ring door frame ring. In embodiments, the washing machine door assembly does not include an inner ring door frame that is used in prior art washer doors to secure the bowl to the outer door frame.

In embodiments, the bowl has a weight of at least 400 grams and not more than 1500 grams, or 400 to 800 grams, and the inside of the bowl defines a volume of at least 1000 $cm^3$ and not more than 7000 $cm^3$, 2000 to 6000 $cm^3$, or 2200 to 3400 $cm^3$. In embodiments, the copolyester makes up at least 50 percent of the total weight of the bowl. In embodiments, the bowl comprises less than 1 weight percent of, or comprises no, bisphenol A polycarbonate.

In embodiments, the first plastic composition has one or more of the following properties: a flexural modulus of at least 1000 MPa and not more than 2100 MPa as measured by ASTM D790; a notched Izod impact of at least 500 J/m, or at least 800 J/m as measured according to ASTM D256 at 23° C. using a 3.2 mm thick bar; an unnotched Izod impact that is no break as measured according to ASTM D256 at 23° C. using a 3.2 mm thick bar; an elongation at break of at least 100%, or at least 200%, as measured according to ASTM D638 at 23° C.; and a glass transition temperature of at least 100° C., or at least 105° C., as measured using DSC at a scan rate of 20° C./min according to ASTM D3418.

In embodiments, the bowl is transparent and has a transmittance of at least 85 percent, or at least 90%, as measured by ASTM D1003, and has a haze of less than 3 percent, or less than 1%, as measured by ASTM D1003. In embodiments, the bowl has a drop impact resistance of at least 3 feet as measure by ASTM D 2463-95.

BRIEF DESCRIPTION OF THE FIGURES

Embodiments of the present invention are described herein with reference to the following drawing figures, wherein.

DETAILED DESCRIPTION

Figure 1:
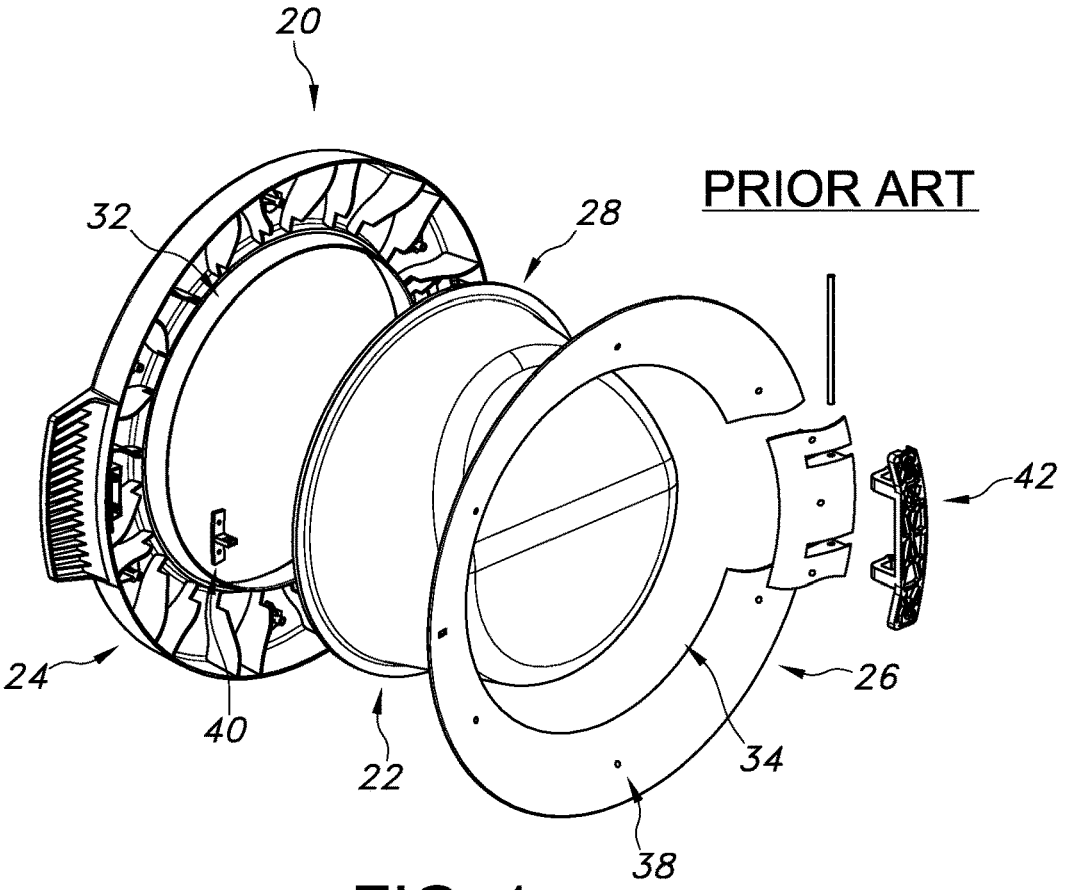
FIG. 1 is a perspective view of a conventional glass bowl door assembly.
Figure 2:
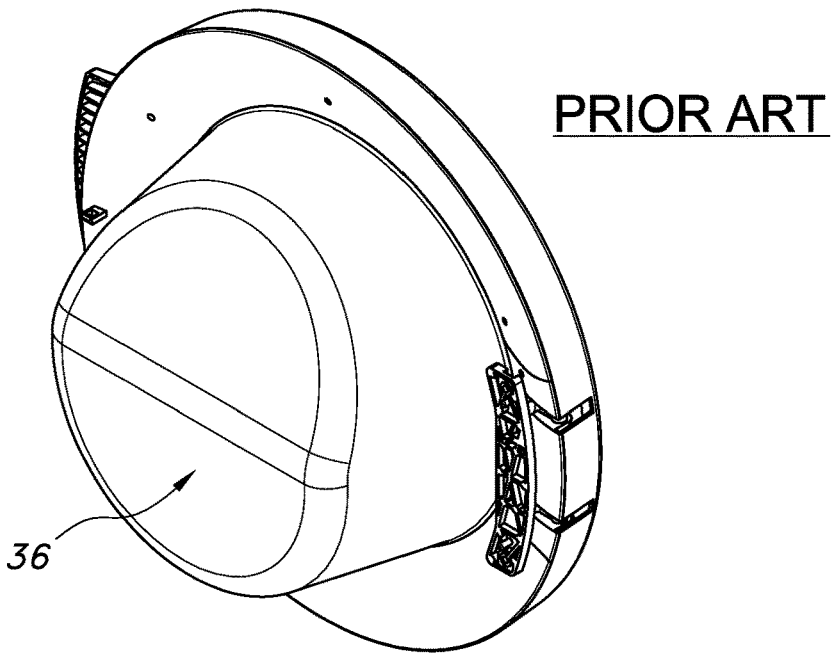
FIG. 2 is a perspective rear (inside) view of an assembled conventional door according to FIG. 1.
Figure 3:
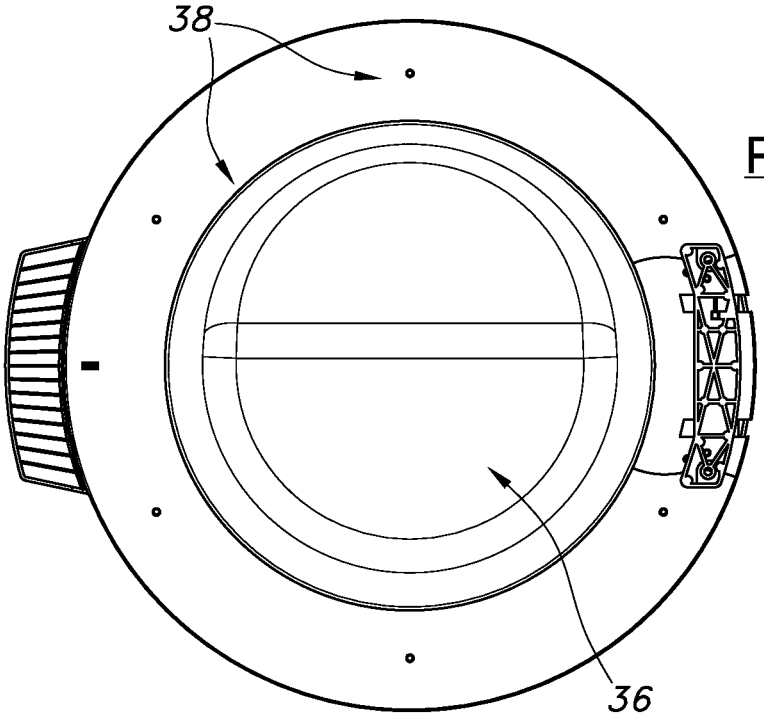
PRIOR ART FIG. 3
FIG. 3 is a rear (inside) view of an assembled conventional door according to FIG. 1.
Figure 4:
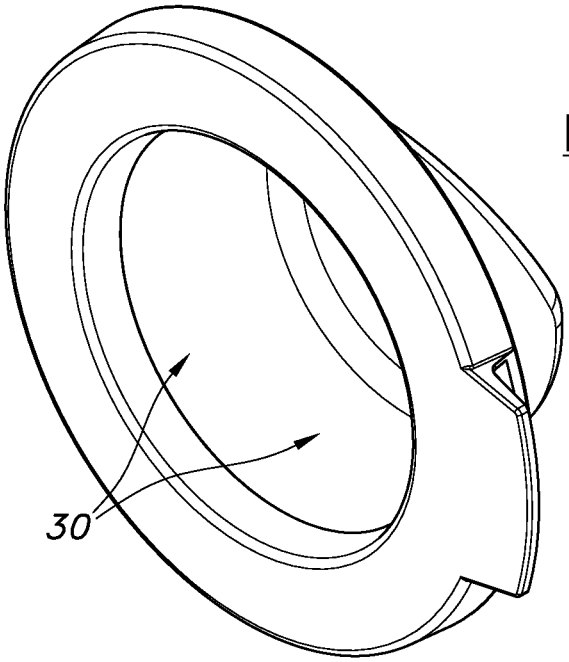
PRIOR ART FIG. 4
FIG. 4 is a perspective front (outside) view of an assembled conventional door according to FIG. 1.

In one embodiment, the present invention is directed to a washing machine door assembly that is easy to assembly, light weight and provides greater design freedom compared to conventional washer door assemblies. Such a washing machine door assembly is suitable for use in front loading, horizontal axis clothes washers.

In one aspect, the washing machine door assembly includes a washer bowl made from a first plastic composition. In embodiments, the bowl can have a weight of at least 300, 400, 500, 600, 700 or 750 grams and/or not more than 1500, 1400, 1200, 1000, or 800 grams. In embodiments, the bowl can have a weight from 300 to 700 grams, or 300 to 600 grams, e.g., for compact washer models. In embodiments, the bowl can have a weight from 600 to 1400 grams, or 700 to 1200 grams, e.g., for large washer models. In contrast, conventional glass washer bowls typically have a weight from 1000 to 3000 grams for compact models and from 4000 to 6000 grams for large models. To ensure that the bowl can fit into a standard washer door assembly and washer treating chamber configuration, in embodiments, the bowl can have a diameter of at least 25, 30, 40, or 45 cm and/or not more than 55, 50, 45, 40 or 35 cm (depending on standard washer sizes).

The strength of the bowl can be measured in terms of drop impact resistance. In one embodiment, the bowl can have a drop impact resistance of at least 3, 4, or 5 feet as measured by ASTM D 2463-95. The enhanced strength of the bowl can be at least partly derived from material selection and/or its physical design. To further illustrate the physical design of the bowl, various features of the bowl are described in detail below with reference to the drawing figures.

FIG. 1 depicts an example of a conventional glass bowl washer door assembly. As shown in FIGS. 1-4, a conventional sandwich type washer door assembly 20 comprises a glass washer bowl 22, which is typically made from cast tempered glass, sandwiched between an outer ring door frame 24 with an opening and an inner ring door frame 26. The glass bowl has a flange 28 at its open end 30 that is sandwiched by the inner circumferential edge of the outer ring 32 and inner circumferential edge of the inner ring 34. The closed end of the glass bowl 36 protrudes through the inner ring frame 26 inward towards the treating chamber of the washer (not shown). The structural integrity of the door assembly is achieved by securing the inner ring frame 26 to the outer ring frame 24 with a series of spaced screws 38. The screws 38 also serve to secure the glass bowl 22 in place by pinching the rings over the glass bowl flange 28. Other hardware, such as a latch member 40 and hinge assembly 42, are secured to the door frame assembly 20.

In embodiments, replacing the glass bowl with a transparent plastic bowl having sufficient physical/performance characteristics for use in a horizontal axis washing machine permits design flexibility and optimization for a washing machine door assembly. In embodiments, the design flexibility or optimization can include enabling part reduction, weight reduction, faster assembly time, or combinations of these.

Figure 5:
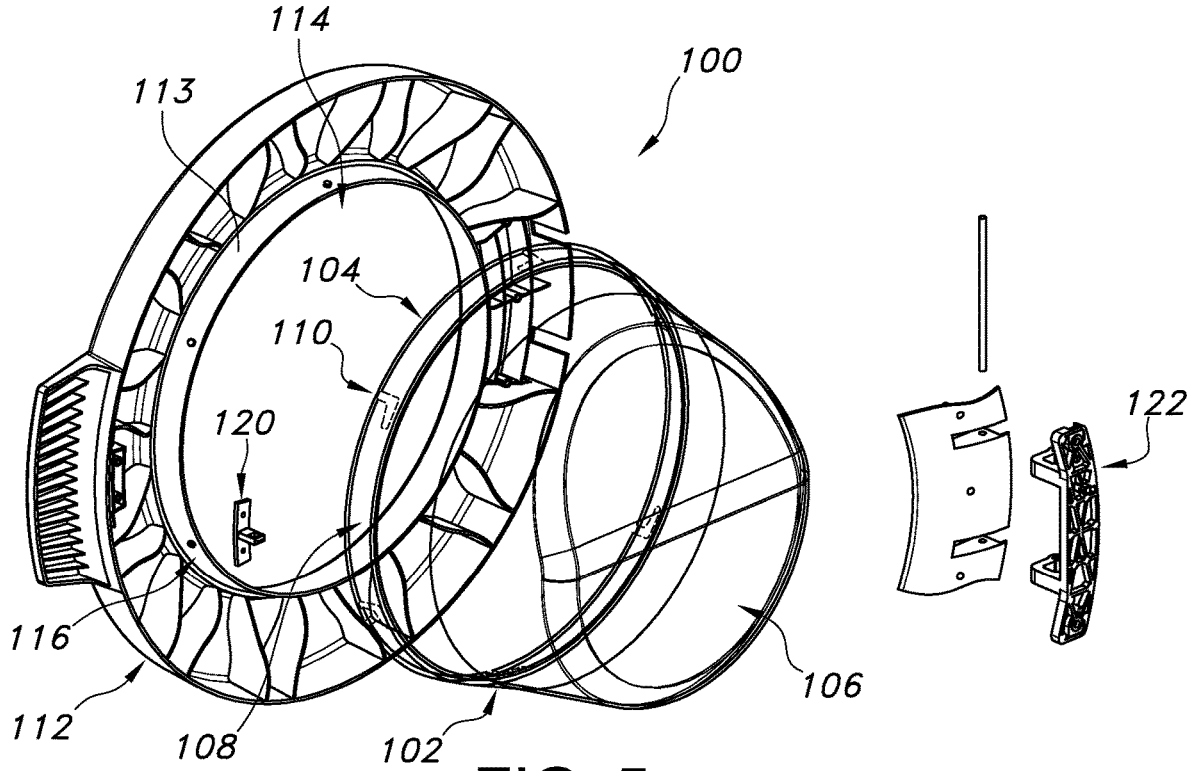
FIG. 5 is a perspective view of a door assembly with twist-lock engagement features.
Figure 6:
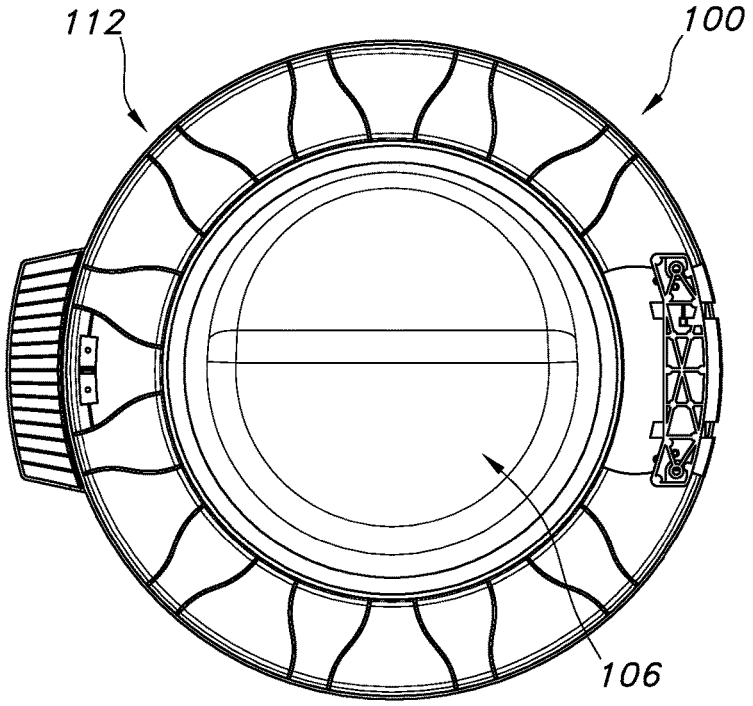
FIG. 6 is a rear (inside) view of an assembled door according to FIG. 5.
Figure 7:
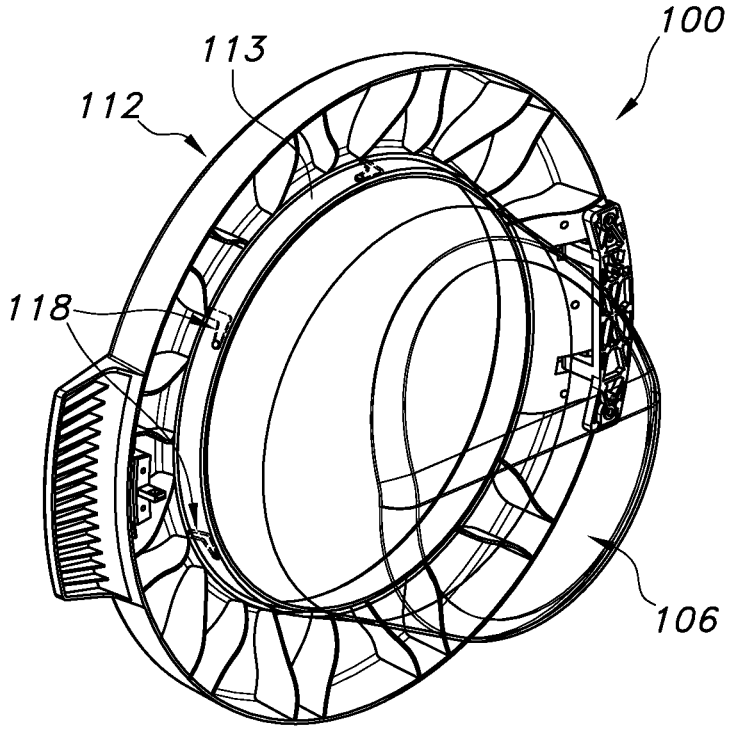
FIG. 7 is a perspective rear (inside) view of an assembled door according to FIG. 5.

As shown in FIGS. 5-7, an embodiment of a washer door assembly 100 is provided that comprises a bowl 102, made from a first plastic composition that comprises, consists of, or consists essentially of a copolyester, having an open end 104 and closed end 106, and having a ring-shaped outer circumferential surface 108 on the inside of the bowl 102 adjacent to and disposed around the perimeter of the open end 104 of the bowl 102. The bowl 102 also includes a plurality of integral engagement feature components, preferably configured as twist lock slots 110 molded into (and integral with) the inner circumferential surface 108 of the bowl. The outer door frame 112 has an opening with a ring-shaped member 113 that extends away from the outer door frame 112 and into the treating chamber of the washer. The ring-shaped member 113 includes an outer circumferential surface 114 with a plurality of integral engagement feature components 116, preferably configured as twist lock posts 116 molded into (and integral with) the outer circumferential surface 114 of the ring-shaped member 113 of the outer door frame 112. The twist lock slots 110 and twist lock posts 116 are present in corresponding numbers and each slot 110 and corresponding post 116 forms a pair of mating (engagement) components 118 which, when interlocked, fixedly engage the inner circumferential surface 108 of the bowl 102 with the outer circumferential surface 114 of the ring-shaped member 113 of the outer door frame 112. Other fastening devices can be used such as screws, bolts, and clips. The structural integrity of the door assembly 100 is achieved by securing the bowl 102 to the ring-shaped member 113 of the outer door frame 112 (as described above), without the need for an inner ring frame or separate securing components, e.g., screws as used with a typical glass bowl assembly. Other hardware, such as a latch member 120 and hinge assembly 122, are secured to the door frame assembly 100.

In embodiments, the twist lock slot and post pair of mating engagement components 118 can releasably fixedly engage the plastic bowl 102 to the outer door frame 112. In other embodiments, the twist lock slot and post pair of mating engagement components 118 can permanently fixedly engage the plastic bowl 102 to the outer door frame 112. Although the above embodiment includes twist lock slot and post pairs of mating engagement components 118 (i.e., a cylindrical post on one surface and a corresponding "L" shaped groove in the other surface), other mating pair engagement component designs can be used, e.g., "T" or "L" shaped posts on one surface and corresponding mating slots on the other surface to accommodate shape of the post, or a teeth and pawl (or other resilient member) ratchet arrangement on the mating surfaces, that lock the bowl in place when the bowl is inserted and rotated. In another preferred embodiment not shown in the drawings, the outer surface of the bowl engages the inner surface of the ring-shaped member and attached by welding or using two or more pairs of mating engagement components.

Figure 8:
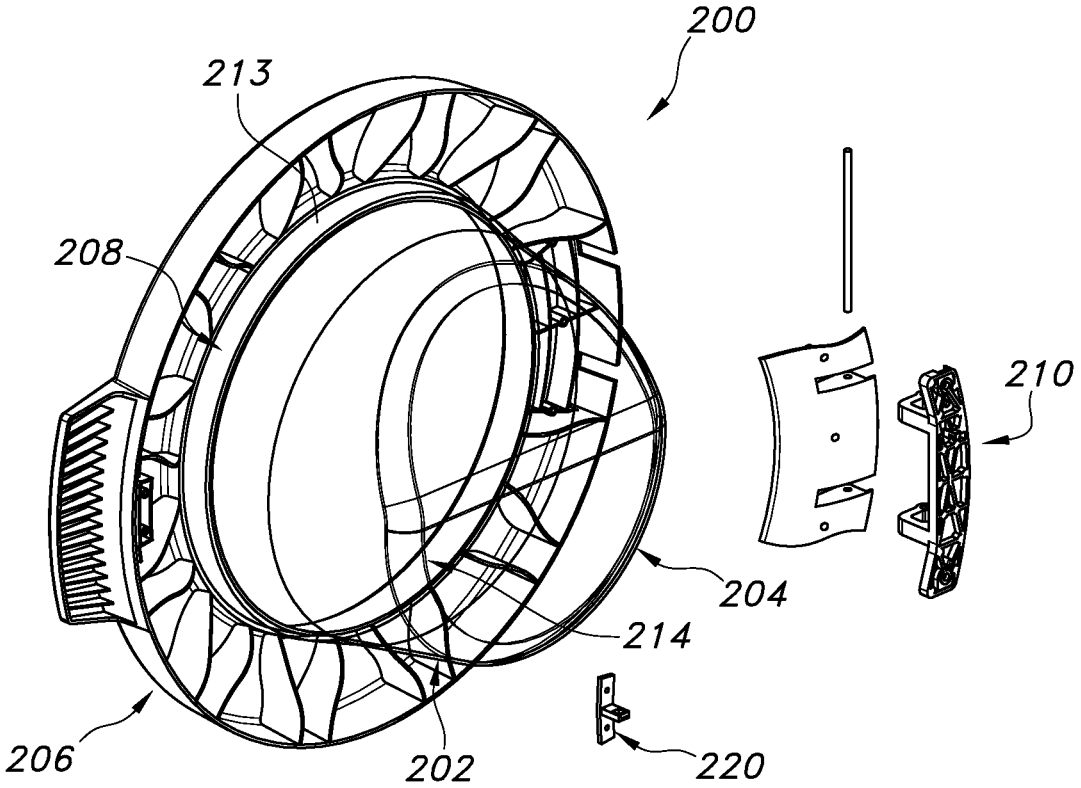
FIG. 8 is a perspective view of a door assembly with a welded surface engagement feature.
Figure 9:
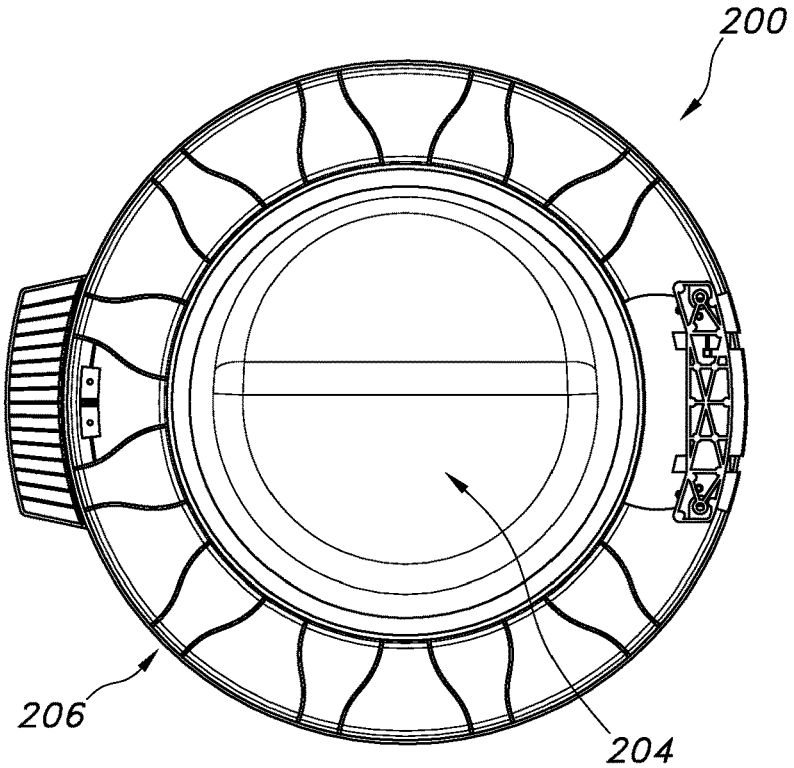
FIG. 9 is a rear (inside) view of an assembled door according to FIG. 8.
Figure 10:
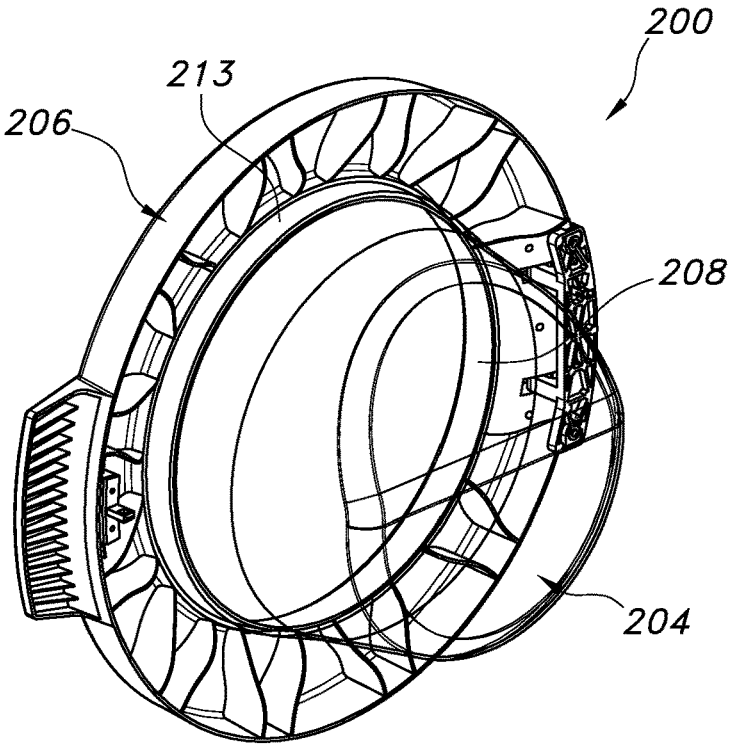
FIG. 10 is a perspective rear (inside) view of an assembled door according to FIG. 8.
Figure 11:
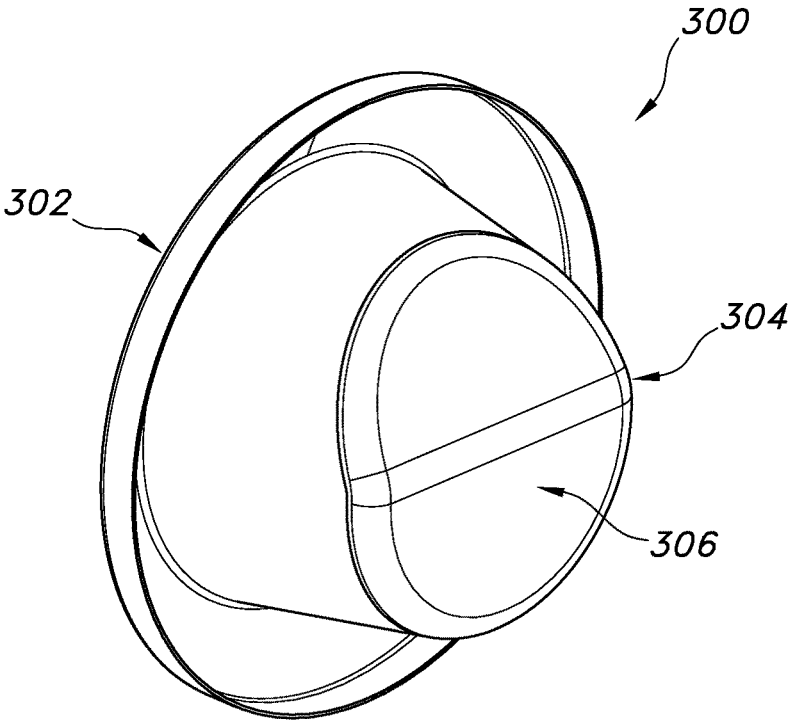
FIG. 11 is a perspective rear (inside) view of a door assembly having a portion of the bowl made from a first polyester material.

As shown in FIGS. 8-10, an embodiment of a washer door assembly 200 is provided that comprises a plastic bowl 202, made from a first plastic composition that comprises, consists of, or consists essentially of a copolyester, having an open end (shown facing away) and closed end 204. The assembly 200 also has an outer door frame 206 that has an opening defined by a ring-shaped member with an outer circumferential surface 214 (shown through the plastic bowl 202). The bowl 202 also includes a ring-shaped inner circumferential surface 208, on the inside of the bowl 202, adjacent to and disposed around the perimeter of the open end of the bowl 202 that is shown fixedly engaged to the outer circumferential surface 214 of the outer door frame 206. The inner circumferential surface 208 of the bowl 202 is fixedly engaged to the outer circumferential surface 214 of the ring-shaped member 213 extending from the outer door frame 206. Preferably, the surfaces are welded together, e.g., by dual shot injection molding where one component, i.e., the bowl 202 or the outer door frame 206, is molded first and the other component is then molded against the pre-existing surface. For example, the outer circumferential surface 214 of the ring-shaped member 213 is molded against the inner circumferential surface 208 of the (pre-molded) bowl 202 or the inner circumferential surface 208 of the bowl 202 is molded against the outer circumferential surface 214 of the (pre-molded) ring-shaped member 213 of the outer door frame 206. The structural integrity of the door assembly 200 is achieved by fixedly engaging the bowl 202 to the outer door frame 206, as described above (where the integral engagement feature is the welded surfaces), without the need for a separate inner ring frame or separate securing components, e.g., screws as used with a typical glass bowl assembly. Other hardware, such as a latch member 220 and hinge assembly 210, are secured to the door frame assembly 200. In embodiments, the surface welding results in the surfaces being permanently fixedly engaged.

As shown in FIGS. 11-14, an embodiment of a washer door assembly 300 is provided that comprises a plastic bowl that is partially made from a first plastic composition that comprises, consists of, or consists essentially of a copolyester and partially made from a second plastic composition (that integrally encompasses that outer door frame 302). The first plastic composition forms the closed end portion 304 of the bowl and has an open end (shown facing away) and closed end 306. In embodiments, the closed end portion 304 of the bowl is transparent and the remaining portion of the bowl (formed from the second plastic and which is integral with the outer door frame 302) is opaque.

Figure 12:
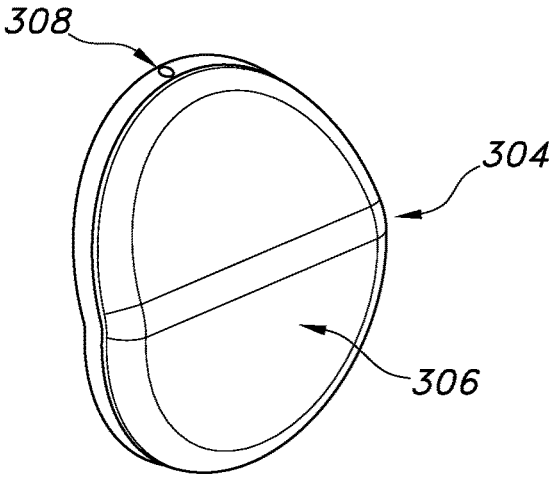
FIG. 12 is a perspective rear (inside) view of a closed end portion of the bowl according to FIG. 11.
Figure 13:
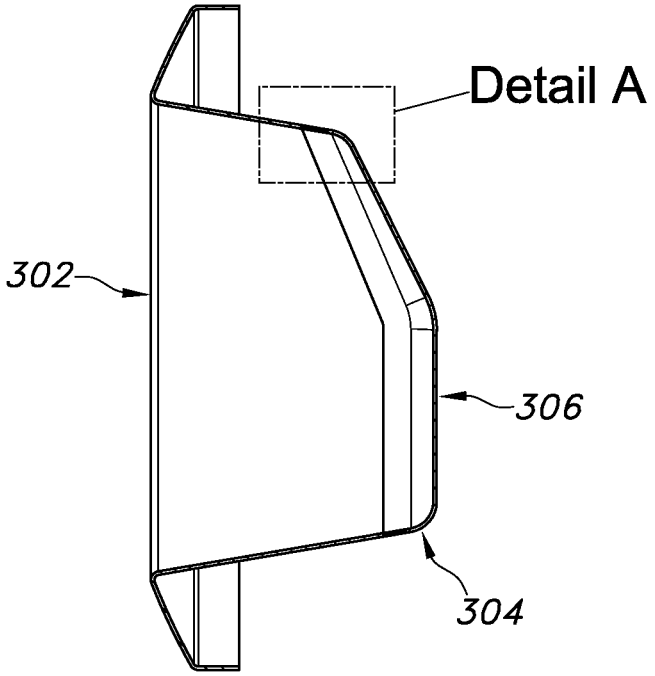
FIG. 13 is a side view of a door assembly according to FIG. 11.

As shown in FIG. 12-13, the closed end portion 306 of the bowl can comprise a minority of the surface area or volume of the overall bowl. The closed end portion 306 of the bowl can be made first by injection molding via a fill gate, e.g., at an edge gate position 308. The outer door frame 302 is fixedly engaged to the closed end portion 304 of the bowl by welding the surfaces together, e.g., by dual shot injection molding, where the second shot is the outer door frame 302 that includes the (majority of or all of) side walls of bowl. In embodiments, the closed end portion 304 of the bowl comprises, consists of, or consists essentially of 50% or less, or 40% or less, or 30% or less, or 25% or less, or 20% or less, or 15% or less, or 10% or less, or 8% or less, or 6% or less, or 5% or less of the total volume of the bowl. In embodiments, the closed end portion 304 of the bowl comprises, consists of, or consists essentially of 1 to 50%, or 1 to 40%, or 1 to 30%, or 1 to 25%, or 1 to 20%, or 1 to 15%, or 1 to 10%, or 1 to 8%, or 1 to 6%, or 1 to 5%, 5 to 50%, or 5 to 40%, or 5 to 30%, or 5 to 25%, or 5 to 20%, or 5 to 15%, or 5 to 10% of the total volume of the bowl.

Figure 14:
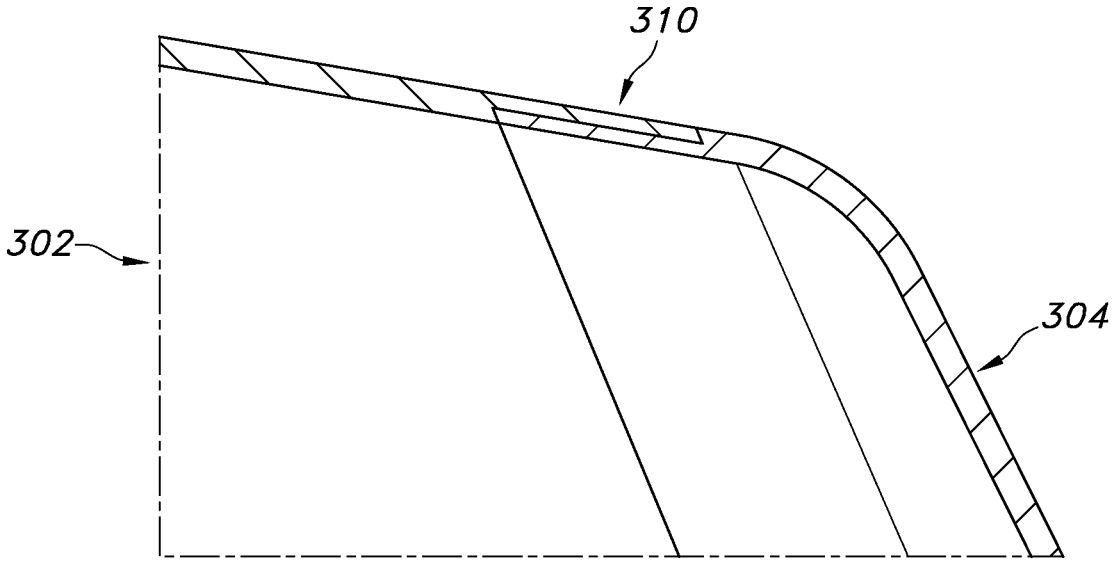
FIG. 14 is an exploded view of the cutaway area A from FIG. 13.

FIG. 14 is an exploded view of the cutaway area in Detail A from FIG. 13. FIG. 14 shows a portion of the outer door frame 302 that is fixedly engaged to the closed end portion 304 of the bowl by welding the surfaces together, e.g., by dual shot injection molding, where the second shot is the outer door frame 302 and includes an over mold portion 310 that encases (or encapsulates) the gate position 308 (not shown in FIG. 14), so that there is no visible blemishes from the molding process of the closed end portion 304 of the bowl.

Figure 15:
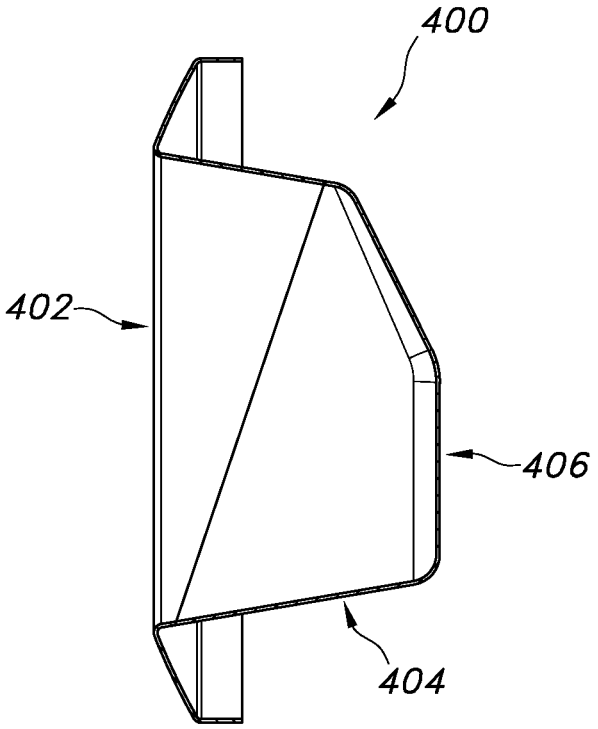
FIG. 15 is a side view of a door assembly having a portion of the bowl made from a first polyester material larger than the portion shown in FIG. 11.

FIG. 15 shows another embodiment where a washer door assembly 400 is provided that comprises a plastic bowl that is partially made from a first plastic composition that comprises, consists of, or consists essentially of a copolyester and partially made from a second plastic composition (that integrally encompasses that outer door frame 402). The first plastic composition forms the closed end portion 404 of the bowl and has an open end (shown facing toward the outer door frame 402) and a closed end 406. In the embodiment shown, the closed end portion 404 of the bowl is transparent and the remaining portion of the bowl (formed from the second plastic and which is integral with the outer door frame 402) is opaque. The closed end portion includes a larger transparent area that permits additional downward visibility for the washing machine user. In embodiments, the size and configuration of the (transparent) closed end of the washer bowl can be selected depending on the desired design and functional aspects. In embodiments, the closed end portion 404 of the bowl comprises, consists of, or consists essentially of 25 to 95%, or 25 to 90%, or 25 to 80%, or 25 to 75%, or 25 to 70%, or 25 to 60%, or 30 to 95%, or 30 to 90%, or 30 to 80%, or 30 to 75%, or 30 to 70%, or 30 to 60%, or 35 to 95%, or 35 to 90%, or 35 to 80%, or 35 to 75%, or 35 to 70%, or 35 to 60%, or 40 to 95%, or 40 to 90%, or 40 to 80%, or 40 to 75%, or 40 to 70%, or 40 to 60%, or 45 to 95%, or 45 to 90%, or 45 to 80%, or 45 to 75%, or 45 to 70%, or 45 to 60%, or 50 to 95%, or 50 to 90%, or 50 to 80%, or 50 to 75%, or 50 to 70%, or 50 to 60% of the total volume of the bowl.

The terminology "releasably fixedly engaging" as used herein means that two components are held together (or engaged) in a fixed relative position and the engagement is maintained under intended use conditions. However, a sufficiently high force can be applied to disengage the two components without damaging the components. The terminology "permanently fixedly engaging" as used herein means that two components are held together (or engaged) in a fixed relative position, the engagement is maintained under intended use conditions and the components cannot be disengaged without damaging at least one of the components.

The terminology "integral" or "integrally" as used herein means that two items or components are formed from a common material. For example, the twist lock slot component is formed from common material that forms the rest of the bowl. Similarly, where the integral engagement feature is the welded surfaces (of the bowl and outer door frame), the surface of the bowl at the weld interface is formed from a common material that forms the rest of the bowl and the surface of the outer door frame at the weld interface is formed from a common material that forms the rest of the outer door frame, although (in the case of different materials for the bowl and door frame) there may be a weld interface that is a mixture in the form of a gradient of the two different materials across a cross-section of the weld.

In embodiments, where the structural integrity of the door assembly is achieved by (directly) fixedly engaging the bowl to the outer door frame as discussed herein, the door assembly may also include an inner ring door frame, e.g., for aesthetic purposes.

In embodiments, the outer door frame may be made from a plastic chosen from ABS thermoplastic, polyester, polycarbonate, or polypropylene. In embodiments, the door frame is molded from ABS thermoplastic or polypropylene. In one embodiment, the door frame is molded from ABS thermoplastic.

In embodiments, the bowl is molded from a polyester composition, where the polyester composition comprises, consists of, or consists essentially of at least one copolyester that comprises, consists of, or consists essentially of:

(a) a dicarboxylic acid component comprising, consisting of, or consisting essentially of:
  i) 70 to 100 mole % of terephthalic acid residues;
  ii) 0 to 30 mole % of aromatic dicarboxylic acid residues having up to 20 carbon atoms; and
  iii) 0 to 10 mole % of aliphatic dicarboxylic acid residues having up to 16 carbon atoms; and
(b) a glycol component comprising, consisting of, or consisting essentially of:
  i) 10 to 99 mole % of 2,2,4,4-tetramethyl-1,3-cyclobutanediol (TMCD) residues; and
  ii) 1 to 90 mole % of 1,4-cyclohexanedimethanol (CHDM) residues, wherein the total mole % of the dicarboxylic acid component is 100 mole %, the total mole % of the glycol component is 100 mole %; and wherein the inherent viscosity of the polyester is from 0.1 to 1.2 dL/g as determined in 60/40 (wt/wt) phenol/tetrachloroethane at a concentration of 0.5 g/100 ml at 25° C.; and wherein the polyester has a Tg of from 100 to 200° C.

In embodiments, the polyester composition comprises, consists of, or consists essentially of at least one copolyester, which comprises, consists of, or consists essentially of:

(a) a dicarboxylic acid component comprising, consisting of, or consisting essentially of:
  i) 70 to 100 mole % of terephthalic acid residues;
  ii) 0 to 30 mole % of aromatic dicarboxylic acid residues having up to 20 carbon atoms; and
  iii) 0 to 10 mole % of aliphatic dicarboxylic acid residues having up to 16 carbon atoms; and
(b) a glycol component comprising, consisting of, or consisting essentially of:
  i) 15 to 70 mole % of 2,2,4,4-tetramethyl-1,3-cyclobutanediol residues; and
  ii) 30 to 85 mole % of 1,4-cyclohexanedimethanol residues, wherein the total mole % of the dicarboxylic acid component is 100 mole %, the total mole % of the glycol component is 100 mole %; and wherein the inherent viscosity of the polyester is from 0.35 to 1.2 dL/g as determined in 60/40 (wt/wt) phenol/tetrachloroethane at a concentration of 0.5 g/100 ml at 25° C.; and wherein the polyester has a Tg of from 100 to 160° C.

In embodiments, the polyester composition comprises, consists of, or consists essentially of at least one copolyester, which comprises, consists of, or consists essentially of:

(a) a dicarboxylic acid component comprising, consisting of, or consisting essentially of:
  i) 70 to 100 mole % of terephthalic acid residues;
  ii) 0 to 30 mole % of aromatic dicarboxylic acid residues having up to 20 carbon atoms; and
  iii) 0 to 10 mole % of aliphatic dicarboxylic acid residues having up to 16 carbon atoms; and
(b) a glycol component comprising, consisting of, or consisting essentially of:
  i) 20 to 40 mole % of 2,2,4,4-tetramethyl-1,3-cyclobutanediol residues; and
  ii) 60 to 80 mole % of 1,4-cyclohexanedimethanol residues, wherein the total mole % of the dicarboxylic acid component is 100 mole %, the total mole % of the glycol component is 100 mole %; and wherein the inherent viscosity of the polyester is from 0.35 to 0.85 dL/g as determined in 60/40 (wt/wt) phenol/tetrachloroethane at a concentration of 0.5 g/100 ml at 25° C.; and wherein the polyester has a Tg of from 100 to 120° C.

In embodiments, the polyester composition comprises, consists of, or consists essentially of at least one copolyester, which comprises, consists of, or consists essentially of:

(a) a dicarboxylic acid component comprising, consisting of, or consisting essentially of:
  i) 70 to 100 mole % of terephthalic acid residues;
  ii) 0 to 30 mole % of aromatic dicarboxylic acid residues having up to 20 carbon atoms; and
  iii) 0 to 10 mole % of aliphatic dicarboxylic acid residues having up to 16 carbon atoms; and
(b) a glycol component comprising, consisting of or, consisting essentially of:
  i) 40 to 55 mole % of 2,2,4,4-tetramethyl-1,3-cyclobutanediol residues; and
  ii) 45 to 60 mole % of 1,4-cyclohexanedimethanol residues, wherein the total mole % of the dicarboxylic acid component is 100 mole %, the total mole % of the glycol component is 100 mole %; and wherein the inherent viscosity of the polyester is from 0.35 to 0.85 dL/g as determined in 60/40 (wt/wt) phenol/tetrachloroethane at a concentration of 0.5 g/100 ml at 25° C.; and wherein the polyester has a Tg of from 120 to 140° C.

In embodiments, the polyester composition comprises, consists of, or consists essentially of at least one copolyester, which comprises, consists of, or consists essentially of:

(a) a dicarboxylic acid component comprising, consisting of or, consisting essentially of:
  i) 70 to 100 mole % of terephthalic acid residues;
  ii) 0 to 30 mole % of aromatic dicarboxylic acid residues having up to 20 carbon atoms; and
  iii) 0 to 10 mole % of aliphatic dicarboxylic acid residues having up to 16 carbon atoms; and
(b) a glycol component comprising, consisting of or, consisting essentially of:
  i) 15 to 70 mole % of 2,2,4,4-tetramethyl-1,3-cyclobutanediol residues; and
  ii) 30 to 85 mole % of 1,4-cyclohexanedimethanol residues, wherein the total mole % of the dicarboxylic acid component is 100 mole %, the total mole % of the glycol component is 100 mole %; and wherein the inherent viscosity of the polyester is from 0.35 to 0.85 dL/g as determined in 60/40 (wt/wt) phenol/tetrachloroethane at a concentration of 0.5 g/100 ml at 25° C.; and wherein the polyester has a Tg of from 100 to 140° C.

In embodiments, the polyester composition comprises, consists of, or consists essentially of at least one copolyester, which comprises, consists of, or consists essentially of:

(a) a dicarboxylic acid component comprising, consisting of or, consisting essentially of:
  i) 70 to 100 mole % of terephthalic acid residues;
  ii) 0 to 30 mole % of aromatic dicarboxylic acid residues having up to 20 carbon atoms; and
  iii) 0 to 10 mole % of aliphatic dicarboxylic acid residues having up to 16 carbon atoms; and
(b) a glycol component comprising, consisting of or, consisting essentially of:
  i) 15 to 90 mole % of 2,2,4,4-tetramethyl-1,3-cyclobutanediol residues; and
  ii) 10 to 85 mole % of 1,4-cyclohexanedimethanol residues, wherein the total mole % of the dicarboxylic acid component is 100 mole %, the total mole % of the glycol component is 100 mole %; and wherein the inherent viscosity of the polyester is from 0.1 to 1.2 dL/g as determined in 60/40 (wt/wt) phenol/tetrachloroethane at a concentration of 0.5 g/100 ml at 25° C.; and wherein the polyester has a Tg of from 100 to 200° C.

In embodiments, any one of the polyesters or polyester compositions described herein can further comprise residues of at least one branching agent. In embodiments, any one of the polyesters or polyester compositions described herein can comprise at least one thermal stabilizer or reaction products thereof.

In embodiments, the polyester composition contains at least one polycarbonate. In other embodiments, the polyester composition contains no polycarbonate.

In embodiments, the polyesters can contain less than 15 mole % ethylene glycol residues, such as, for example, 0.01 to less than 15 mole % ethylene glycol residues. In embodiments, the polyesters useful in the invention contain less than 10 mole %, or less than 5 mole %, or less than 4 mole %, or less than 2 mole %, or less than 1 mole % ethylene glycol residues, such as, for example, 0.01 to less than 10 mole %, or 0.01 to less than 5 mole %, or 0.01 to less than 4 mole %, or 0.01 to less than 2 mole %, or 0.01 to less than 1 mole %, ethylene glycol residues. In one embodiment, the polyesters useful in the invention contain no ethylene glycol residues.

A In embodiments, the glycol component for the polyesters can include but is not limited to at least one of the following combinations of ranges: 10 to 99 mole % 2,2,4,4-tetramethyl-1,3-cyclobutanediol and 1 to 90 mole % 1,4-cyclohexanedimethanol; 10 to 95 mole % 2,2,4,4-tetramethyl-1,3-cyclobutanediol and 5 to 90 mole % 1,4-cyclohexanedimethanol; 10 to 90 mole % 2,2,4,4-tetramethyl-1,3-cyclobutanediol and 10 to 90 mole % 1,4-cyclohexanedimethanol; 10 to 85 mole % 2,2,4,4-tetramethyl-1,3-cyclobutanediol and 15 to 90 mole % 1,4-cyclohexanedimethanol; 10 to 80 mole % 2,2,4,4-tetramethyl-1,3-cyclobutanediol and 20 to 90 mole % 1,4-cyclohexanedimethanol, 10 to 75 mole % 2,2,4,4-tetramethyl-1,3-cyclobutanediol and 25 to 90 mole % 1,4-cyclohexanedimethanol; 10 to 70 mole % 2,2,4,4-tetramethyl-1,3-cyclobutanediol and 30 to 90 mole % 1,4-cyclohexanedimethanol; 10 to 65 mole % 2,2,4,4-tetramethyl-1,3-cyclobutanediol and 35 to 90 mole % 1,4-cyclohexanedimethanol; 10 to 60 mole % 2,2,4,4-tetramethyl-1,3-cyclobutanediol and 40 to 90 mole % 1,4-cyclohexanedimethanol; 10 to 55 mole % 2,2,4,4-tetramethyl-1,3-cyclobutanediol and 45 to 90 mole % 1,4-cyclohexanedimethanol; 10 to 50 mole % 2,2,4,4-tetramethyl-1,3-cyclobutanediol and 50 to 90 mole % 1,4-cyclohexanedimethanol; 10 to less than 50 mole % 2,2,4,4-tetramethyl-1,3-cyclobutanediol and greater than 50 to 90 mole % 1,4-cyclohexanedimethanol; 10 to 45 mole % 2,2,4,4-tetramethyl-1,3-cyclobutanediol and 55 to 90 mole % 1,4-cyclohexanedimethanol; 10 to 40 mole % 2,2,4,4-tetramethyl-1,3-cyclobutanediol and 60 to 90 mole % 1,4-cyclohexanedimethanol; 10 to 35 mole % 2,2,4,4-tetramethyl-1,3-cyclobutanediol and 65 to 90 mole % 1,4-cyclohexanedimethanol; 10 to less than 35 mole % 2,2,4,4-tetramethyl-1,3-cyclobutanediol and greater than 65 up to 90 mole % 1,4-cyclohexanedimethanol; 10 to 30 mole % 2,2,4,4-tetramethyl-1,3-cyclobutanediol and 70 to 90 mole % 1,4-cyclohexanedimethanol; 10 to 25 mole % 2,2,4,4-tetramethyl-1,3-cyclobutanediol and greater than 75 to 90 mole % 1,4-cyclohexanedimethanol; 11 to 25 mole % 2,2,4,4-tetramethyl-1,3-cyclobutanediol and 75 to 89 mole % 1,4-cyclohexanedimethanol; 12 to 25 mole % 2,2,4,4-tetramethyl-1,3-cyclobutanediol and 75 to 88 mole % 1,4-cyclohexanedimethanol; and 13 to 25 mole % 2,2,4,4-tetramethyl-1,3-cyclobutanediol and 75 to 87 mole % 1,4-cyclohexanedimethanol.

In other embodiments, the glycol component for the polyesters can include but is not limited to at least one of the following combinations of ranges: 14 to 99 mole % 2,2,4,4-tetramethyl-1,3-cyclobutanediol and 1 to 86 mole % 1,4-cyclohexanedimethanol; 14 to 95 mole % 2,2,4,4-tetramethyl-1,3-cyclobutanediol and 5 to 86 mole % 1,4-cyclohexanedimethanol; 14 to 90 mole % 2,2,4,4-tetramethyl-1,3-cyclobutanediol and 10 to 86 mole % 1,4-cyclohexanedimethanol; 14 to 85 mole % 2,2,4,4-tetramethyl-1,3-cyclobutanediol and 15 to 86 mole % 1,4-cyclohexanedimethanol; 14 to 80 mole % 2,2,4,4-tetramethyl-1,3-cyclobutanediol and 20 to 86 mole % 1,4-cyclohexanedimethanol, 14 to 75 mole % 2,2,4,4-tetramethyl-1,3-cyclobutanediol and 25 to 86 mole % 1,4-cyclohexanedimethanol; 14 to 70 mole % 2,2,4,4-tetramethyl-1,3-cyclobutanediol and 30 to 86 mole % 1,4-cyclohexanedimethanol; 14 to 65 mole % 2,2,4,4-tetramethyl-1,3-cyclobutanediol and 35 to 86 mole % 1,4-cyclohexanedimethanol; 14 to 60 mole % 2,2,4,4-tetramethyl-1,3-cyclobutanediol and 40 to 86 mole % 1,4-cyclohexanedimethanol; 14 to 55 mole % 2,2,4,4-tetramethyl-1,3-cyclobutanediol and 45 to 86 mole % 1,4-cyclohexanedimethanol; and 14 to 50 mole % 2,2,4,4-tetramethyl-1,3-cyclobutanediol and 50 to 86 mole % 1,4-cyclohexanedimethanol.

In other embodiments, the glycol component for the polyesters can include but is not limited to at least one of the following combinations of ranges: 15 to 99 mole % 2,2,4,4-tetramethyl-1,3-cyclobutanediol and 1 to 85 mole % 1,4-cyclohexanedimethanol; 15 to 95 mole % 2,2,4,4-tetramethyl-1,3-cyclobutanediol and 5 to 85 mole % 1,4-cyclohexanedimethanol; 15 to 90 mole % 2,2,4,4-tetramethyl-1,3-cyclobutanediol and 10 to 85 mole % 1,4-cyclohexanedimethanol; 15 to 85 mole % 2,2,4,4-tetramethyl-1,3-cyclobutanediol and 15 to 85 mole % 1,4-cyclohexanedimethanol; 15 to 80 mole % 2,2,4,4-tetramethyl-1,3-cyclobutanediol and 20 to 85 mole % 1,4-cyclohexanedimethanol, 15 to 75 mole % 2,2,4,4-tetramethyl-1,3-cyclobutanediol and 25 to 85 mole % 1,4-cyclohexanedimethanol; 15 to 70 mole % 2,2,4,4-tetramethyl-1,3-cyclobutanediol and 30 to 85 mole % 1,4-cyclohexanedimethanol; 15 to 65 mole % 2,2,4,4-tetramethyl-1,3-cyclobutanediol and 35 to 85 mole % 1,4-cyclohexanedimethanol; 15 to 60 mole % 2,2,4,4-tetramethyl-1,3-cyclobutanediol and 40 to 85 mole % 1,4-cyclohexanedimethanol; 15 to 55 mole % 2,2,4,4-tetramethyl-1,3-cyclobutanediol and 45 to 85 mole % 1,4-cyclohexanedimethanol; and 15 to 50 mole % 2,2,4,4-tetramethyl-1,3-cyclobutanediol and 50 to 85 mole % 1,4-cyclohexanedimethanol.

In other embodiments, the glycol component for the polyesters can include but is not limited to at least one of the following combinations of ranges: 15 to less than 50 mole % 2,2,4,4-tetramethyl-1,3-cyclobutanediol and greater than 50 up to 85 mole % 1,4-cyclohexanedimethanol; 15 to 45 mole % 2,2,4,4-tetramethyl-1,3-cyclobutanediol and 55 to 85 mole % 1,4-cyclohexanedimethanol; 15 to 40 mole % 2,2,4,4-tetramethyl-1,3-cyclobutanediol and 60 to 85 mole % 1,4-cyclohexanedimethanol; 15 to 35 mole % 2,2,4,4-tetramethyl-1,3-cyclobutanediol and 65 to 85 mole % 1,4-cyclohexanedimethanol; 15 to 30 mole % 2,2,4,4-tetramethyl-1,3-cyclobutanediol and 70 to 85 mole % 1,4-cyclohexanedimethanol; 15 to 25 mole % 2,2,4,4-tetramethyl-1,3-cyclobutanediol and 75 to 85 mole % 1,4-cyclohexanedimethanol; 15 to 20 mole % 2,2,4,4-tetramethyl-1,3-cyclobutanediol and 75 to 80 mole % 1,4-cyclohexanedimethanol; and 17 to 23 mole % 2,2,4,4-tetramethyl-1,3-cyclobutanediol and 77 to 83 mole % 1,4-cyclohexanedimethanol.

In other embodiments, the glycol component for the polyesters can include but is not limited to at least one of the following combinations of ranges: 20 to 99 mole % 2,2,4,4-tetramethyl-1,3-cyclobutanediol and 1 to 80 mole % 1,4-cyclohexanedimethanol; 20 to 95 mole % 2,2,4,4-tetramethyl-1,3-cyclobutanediol and 5 to 80 mole % 1,4-cyclohexanedimethanol; 20 to 90 mole % 2,2,4,4-tetramethyl-1,3-cyclobutanediol and 10 to 80 mole % 1,4-cyclohexanedimethanol; 20 to 85 mole % 2,2,4,4-tetramethyl-1,3-cyclobutanediol and 15 to 80 mole % 1,4-cyclohexanedimethanol; 20 to 80 mole % 2,2,4,4-tetramethyl-1,3-cyclobutanediol and 20 to 80 mole % 1,4-cyclohexanedimethanol, 20 to 75 mole % 2,2,4,4-tetramethyl-1,3-cyclobutanediol and 25 to 80 mole % 1,4-cyclohexanedimethanol; 20 to 70 mole % 2,2,4,4-tetramethyl-1,3-cyclobutanediol and 30 to 80 mole % 1,4-cyclohexanedimethanol; 20 to 65 mole % 2,2,4,4-tetramethyl-1,3-cyclobutanediol and 35 to 80 mole % 1,4-cyclohexanedimethanol; 20 to 60 mole % 2,2,4,4-tetramethyl-1,3-cyclobutanediol and 40 to 80 mole % 1,4-cyclohexanedimethanol; 20 to 55 mole % 2,2,4,4-tetramethyl-1,3-cyclobutanediol and 45 to 80 mole % 1,4-cyclohexanedimethanol; 20 to 50 mole % 2,2,4,4-tetramethyl-1,3-cyclobutanediol and 50 to 80 mole % 1,4-cyclohexanedimethanol; 20 to 45 mole % 2,2,4,4-tetramethyl-1,3-cyclobutanediol and 55 to 80 mole % 1,4-cyclohexanedimethanol; 20 to 40 mole % 2,2,4,4-tetramethyl-1,3-cyclobutanediol and 60 to 80 mole % 1,4-cyclohexanedimethanol; 20 to 35 mole % 2,2,4,4-tetramethyl-1,3-cyclobutanediol and 65 to 80 mole % 1,4-cyclohexanedimethanol; 20 to 30 mole % 2,2,4,4-tetramethyl-1,3-cyclobutanediol and 70 to 80 mole % 1,4-cyclohexandimethanol; and 20 to 25 mole % 2,2,4,4-tetramethyl-1,3-cyclobutanediol and 75 to 80 mole % 1,4-cyclohexanedimethanol.

In other embodiments, the glycol component for the polyesters can include but is not limited to at least one of the following combinations of ranges: 25 to 99 mole % 2,2,4,4-tetramethyl-1,3-cyclobutanediol and 1 to 75 mole % 1,4-cyclohexanedimethanol; 25 to 95 mole % 2,2,4,4-tetramethyl-1,3-cyclobutanediol and 5 to 75 mole % 1,4-cyclohexanedimethanol; 25 to 90 mole % 2,2,4,4-tetramethyl-1,3-cyclobutanediol and 10 to 75 mole % 1,4-cyclohexanedimethanol; 25 to 85 mole % 2,2,4,4-tetramethyl-1,3-cyclobutanediol and 15 to 75 mole % 1,4-cyclohexanedimethanol; 25 to 80 mole % 2,2,4,4-tetramethyl-1,3-cyclobutanediol and 20 to 75 mole % 1,4-cyclohexanedimethanol, 25 to 75 mole % 2,2,4,4-tetramethyl-1,3-cyclobutanediol and 25 to 75 mole % 1,4-cyclohexanedimethanol; 25 to 70 mole % 2,2,4,4-tetramethyl-1,3-cyclobutanediol and 30 to 75 mole % 1,4-cyclohexanedimethanol; 25 to 65 mole % 2,2,4,4-tetramethyl-1,3-cyclobutanediol and 35 to 75 mole % 1,4-cyclohexanedimethanol; 25 to 60 mole % 2,2,4,4-tetramethyl-1,3-cyclobutanediol and 40 to 75 mole % 1,4-cyclohexanedimethanol; 25 to 55 mole % 2,2,4,4-tetramethyl-1,3-cyclobutanediol and 45 to 75 mole % 1,4-cyclohexanedimethanol; 25 to 50 mole % 2,2,4,4-tetramethyl-1,3-cyclobutanediol and 50 to 75 mole % 1,4-cyclohexanedimethanol; 25 to 45 mole % 2,2,4,4-tetramethyl-1,3-cyclobutanediol and 55 to 75 mole % 1,4-cyclohexanedimethanol; 25 to 40 mole % 2,2,4,4-tetramethyl-1,3-cyclobutanediol and 60 to 75 mole % 1,4-cyclohexanedimethanol; 25 to 35 mole % 2,2,4,4-tetramethyl-1,3-cyclobutanediol and 65 to 75 mole % 1,4-cyclohexanedimethanol; and 25 to 30 mole % 2,2,4,4-tetramethyl-1,3-cyclobutanediol and 70 to 75 mole % 1,4-cyclohexanedimethanol.

In other embodiments, the glycol component for the polyesters can include but is not limited to at least one of the following combinations of ranges: 30 to 99 mole % 2,2,4,4-tetramethyl-1,3-cyclobutanediol and 1 to 70 mole % 1,4-cyclohexanedimethanol; 30 to 95 mole % 2,2,4,4-tetramethyl-1,3-cyclobutanediol and 5 to 70 mole % 1,4-cyclohexanedimethanol; 30 to 90 mole % 2,2,4,4-tetramethyl-1,3-cyclobutanediol and 10 to 70 mole % 1,4-cyclohexanedimethanol; 30 to 85 mole % 2,2,4,4-tetramethyl-1,3-cyclobutanediol and 15 to 70 mole % 1,4-cyclohexanedimethanol; 30 to 80 mole % 2,2,4,4-tetramethyl-1,3-cyclobutanediol and 20 to 70 mole % 1,4-cyclohexanedimethanol, 30 to 75 mole % 2,2,4,4-tetramethyl-1,3-cyclobutanediol and 25 to 70 mole % 1,4-cyclohexanedimethanol; 30 to 70 mole % 2,2,4,4-tetramethyl-1,3-cyclobutanediol and 30 to 70 mole % 1,4-cyclohexanedimethanol; 30 to 65 mole % 2,2,4,4-tetramethyl-1,3-cyclobutanediol and 35 to 70 mole % 1,4-cyclohexanedimethanol; 30 to 60 mole % 2,2,4,4-tetramethyl-1,3-cyclobutanediol and 40 to 70 mole % 1,4-cyclohexanedimethanol; 30 to 55 mole % 2,2,4,4-tetramethyl-1,3-cyclobutanediol and 45 to 70 mole % 1,4-cyclohexanedimethanol; 30 to 50 mole % 2,2,4,4-tetramethyl-1,3-cyclobutanediol and 50 to 70 mole % 1,4-cyclohexanedimethanol; 30 to less than 50 mole % 2,2,4,4-tetramethyl-1,3-cyclobutanediol and greater than 50 to 70 mole % 1,4-cyclohexanedimethanol; 30 to 45 mole % 2,2,4,4-tetramethyl-1,3-cyclobutanediol and 55 to 70 mole % 1,4-cyclohexanedimethanol; 30 to 40 mole % 2,2,4,4-tetramethyl-1,3-cyclobutanediol and 60 to 70 mole % 1,4-cyclohexanedimethanol; 30 to 35 mole % 2,2,4,4-tetramethyl-1,3-cyclobutanediol and 65 to 70 mole % 1,4-cyclohexanedimethanol.

In addition to the diols set forth above, in certain embodiments the polyesters may also be made from 1,3-propanediol, 1,4-butanediol, or mixtures thereof. It is contemplated that compositions made from 1,3-propanediol, 1,4-butanediol, or mixtures thereof can possess at least one of the Tg ranges described herein, at least one of the inherent viscosity ranges described herein, and/or at least one of the glycol or diacid ranges described herein. In addition or in the alternative, the polyesters made from 1,3-propanediol or 1,4-butanediol or mixtures thereof may also be made from 1,4-cyclohexanedmethanol in at least one of the following amounts: from 0.1 to 99 mole %; from 0.1 to 90 mole %; from 0.1 to 80 mole %; from 0.1 to 70 mole %; from 0.1 to 60 mole %; from 0.1 to 50 mole %; from 0.1 to 40 mole %; from 0.1 to 35 mole %; from 0.1 to 30 mole %; from 0.1 to 25 mole %; from 0.1 to 20 mole %; from 0.1 to 15 mole %; from 0.1 to 10 mole %; from 0.1 to 5 mole %; from 1 to 99 mole %; from 1 to 90 mole %, from 1 to 80 mole %; from 1 to 70 mole %; from 1 to 60 mole %; from 1 to 50 mole %; from 1 to 40 mole %; from 1 to 35 mole %; from 1 to 30 mole %; from 1 to 25 mole %; from 1 to 20 mole %; from 1 to 15 mole %; from 1 to 10 mole %; from 1 to 5 mole %; from 5 to 99 mole %, from 5 to 90 mole %, from 5 to 80 mole %; 5 to 70 mole %; from 5 to 60 mole %; from 5 to 50 mole %; from 5 to 40 mole %; from 5 to 35 mole %; from 5 to 30 mole %; from 5 to 25 mole %; from 5 to 20 mole %; and from 5 to 15 mole %; from 5 to 10 mole %; from 10 to 99 mole %; from 10 to 90 mole %; from 10 to 80 mole %; from 10 to 70 mole %; from 10 to 60 mole %; from 10 to 50 mole %; from 10 to 40 mole %; from 10 to 35 mole %; from 10 to 30 mole %; from 10 to 25 mole %; from 10 to 20 mole %; from 10 to 15 mole %; from 20 to 99 mole %; from 20 to 90 mole %; from 20 to 80 mole %; from 20 to 70 mole %; from 20 to 60 mole %; from 20 to 50 mole %; from 20 to 40 mole %; from 20 to 35 mole %; from 20 to 30 mole %; and from 20 to 25 mole.

In certain embodiments, the glycol component of the polyester portion of the polyester composition can contain 25 mole % or less of one or more modifying glycols which are not 2,2,4,4-tetramethyl-1,3-cyclobutanediol or 1,4-cyclohexanedimethanol; in one embodiment, the polyesters useful in the invention may contain less than 15 mole % of one or more modifying glycols. In another embodiment, the polyesters can contain 10 mole % or less of one or more modifying glycols. In another embodiment, the polyesters can contain 5 mole % or less of one or more modifying glycols. In another embodiment, the polyesters can contain 3 mole % or less of one or more modifying glycols. In another embodiment, the polyesters can contain 0 mole % modifying glycols. Certain embodiments can also contain 0.01 or more mole %, such as 0.1 or more mole %, 1 or more mole %, 5 or more mole %, or 10 or more mole % of one or more modifying glycols. Thus, if present, it is contemplated that the amount of one or more modifying glycols can range from any of these preceding endpoint values including, for example, from 0.01 to 15 mole % and from 0.1 to 10 mole %.

In embodiments, modifying glycols useful in the polyesters refer to diols other than 2,2,4,4-tetramethyl-1,3-cyclobutanediol and 1,4-cyclohexanedimethanol and may contain 2 to 16 carbon atoms. Examples of suitable modifying glycols in certain embodiments include, but are not limited to, ethylene glycol, 1,2-propanediol, 1,3-propanediol, neopentyl glycol, 1,4-butanediol, 1,5-pentanediol, 1,6-hexanediol, p-xylene glycol or mixtures thereof. In one embodiment, the modifying glycol is ethylene glycol. In another embodiment, the modifying glycols are 1,3-propanediol and/or 1,4-butanediol. In another embodiment, ethylene glycol is excluded as a modifying diol. In another embodiment, 1,3-propanediol and 1,4-butanediol are excluded as modifying diols. In another embodiment, 2,2-dimethyl-1,3-propanediol is excluded as a modifying diol.

In embodiments, the polyesters and/or the polycarbonates (if included) useful in the polyesters compositions can comprise from 0 to 10 mole percent, for example, from 0.01 to 5 mole percent, from 0.01 to 1 mole percent, from 0.05 to 5 mole percent, from 0.05 to 1 mole percent, or from 0.1 to 0.7 mole percent, based the total mole percentages of either the diol or diacid residues; respectively, of one or more residues of a branching monomer, also referred to herein as a branching agent, having 3 or more carboxyl substituents, hydroxyl substituents, or a combination thereof. In certain embodiments, the branching monomer or agent may be added prior to and/or during and/or after the polymerization of the polyester.

In embodiments, the mole % of cis-2,2,4,4-tetramethyl-1,3-cyclobutanediol in certain polyesters is greater than 50 mole % or greater than 55 mole % of cis-2,2,4,4-tetramethyl-1,3-cyclobutanediol or greater than 70 mole % of cis-2,2,4,4-tetramethyl-1,3-cyclobutanediol; wherein the total mole percentage of cis-2,2,4,4-tetramethyl-1,3-cyclobutanediol and trans-2,2,4,4-tetramethyl-1,3-cyclobutanediol is equal to a total of 100 mole %.

In embodiments, the mole % of the isomers of 2,2,4,4-tetramethyl-1,3-cyclobutanediol in certain polyesters is from 30 to 70 mole % of cis-2,2,4,4-tetramethyl-1,3-cyclobutanediol or from 30 to 70 mole % of trans-2,2,4,4-tetramethyl-1,3-cyclobutanediol, or from 40 to 60 mole % of cis-2,2,4,4-tetramethyl-1,3-cyclobutanediol or from 40 to 60 mole % of trans-2,2,4,4-tetramethyl-1,3-cyclobutanediol, wherein the total mole percentage of cis-2,2,4,4-tetramethyl-1,3-cyclobutanediol and trans-2,2,4,4-tetramethyl-1,3-cyclobutanediol is equal to a total of 100 mole %.

In certain embodiments, the polyesters can be amorphous or semi-crystalline. In one aspect, certain polyesters can have a relatively low crystallinity. Certain polyesters can thus have a substantially amorphous morphology, meaning that the polyesters comprise substantially unordered regions of polymer.

In embodiments, the polyester(s) and/or polyester composition(s) can have a unique combination of two or more physical properties such as high impact strengths, moderate to high glass transition temperatures, chemical resistance, hydrolytic stability, toughness, low ductile-to-brittle transition temperatures, good color and clarity, low densities, long crystallization half-times, and good processability thereby easily permitting them to be formed into articles. In some of the embodiments, the polyesters can have a unique combination of the properties of good impact strength, heat resistance, chemical resistance, density and/or the combination of the properties of good impact strength, heat resistance, and processability and/or the combination of two or more of the described properties.

In embodiments, the polyesters can be prepared from dicarboxylic acids and diols which react in substantially equal proportions and are incorporated into the polyester polymer as their corresponding residues. The polyesters, therefore, can contain substantially equal molar proportions of acid residues (100 mole %) and diol (and/or multifunctional hydroxyl compounds) residues (100 mole %) such that the total moles of repeating units is equal to 100 mole %. The mole percentages provided in the present disclosure, therefore, may be based on the total moles of acid residues, the total moles of diol residues, or the total moles of repeating units. For example, a polyester containing 30 mole % isophthalic acid, based on the total acid residues, means the polyester contains 30 mole % isophthalic acid residues out of a total of 100 mole % acid residues. Thus, there are 30 moles of isophthalic acid residues among every 100 moles of acid residues. In another example, a polyester containing 30 mole % 2,2,4,4-tetramethyl-1,3-cyclobutanediol, based on the total diol residues, means the polyester contains 30 mole % 2,2,4,4-tetramethyl-1,3-cyclobutanediol residues out of a total of 100 mole % diol residues. Thus, there are 30 moles of 2,2,4,4-tetramethyl-1,3-cyclobutanediol residues among every 100 moles of diol residues.

In embodiments, the Tg of the polyesters can be at least one of the following ranges: 100 to 200° C.; 100 to 190° C.; 100 to 180° C.; 100 to 170° C.; 100 to 160° C.; 100 to 155° C.; 100 to 150° C.; 100 to 145° C.; 100 to 140° C.; 100 to 138° C.; 100 to 135° C.; 100 to 130° C.; 100 to 125° C.; 100 to 120° C.; 100 to 115° C.; 100 to 110° C.; 105 to 200° C.; 105 to 190° C.; 105 to 180° C.; 105 to 170° C.; 105 to 160° C.; 105 to 155° C.; 105 to 150° C.; 105 to 145° C.; 105 to 140° C.; 105 to 138° C.; 105 to 135° C.; 105 to 130° C.; 105 to 125° C.; 105 to 120° C.; 105 to 115° C.; 105 to 110° C. greater than 105 to 125° C.; greater than 105 to 120° C.; greater than 105 to 115° C.; greater than 105 to 110° C.; 110 to 200° C.; 110 to 190° C.; 110 to 180° C.; 110 to 170° C.; 110 to 160° C.; 110 to 155° C.; 110 to 150° C.; 110 to 145° C.; 110 to 140° C.; 110 to 138° C.; 110 to 135° C.; 110 to 130° C.; 110 to 125° C.; 110 to 120° C.; 110 to 115° C.; 115 to 200° C.; 115 to 190° C.; 115 to 180° C.; 115 to 170° C.; 115 to 160° C.; 115 to 155° C.; 115 to 150° C.; 115 to 145° C.; 115 to 140° C.; 115 to 138° C.; 115 to 135° C.; 110 to 130° C.; 115 to 125° C.; 115 to 120° C.; 120 to 200° C.; 120 to 190° C.; 120 to 180° C.; 120 to 170° C.; 120 to 160° C.; 120 to 155° C.; 120 to 150° C.; 120 to 145° C.; 120 to 140° C.; 120 to 138° C.; 120 to 135° C.; 120 to 130° C.; 125 to 200° C.; 125 to 190° C.; 125 to 180° C.; 125 to 170° C.; 125 to 160° C.; 125 to 155° C.; 125 to 150° C.; 125 to 145° C.; 125 to 140° C.; 125 to 138° C.; 125 to 135° C.; 127 to 200° C.; 127 to 190° C.; 127 to 180° C.; 127 to 170° C.; 127 to 160° C.; 127 to 150° C.; 127 to 145° C.; 127 to 140° C.; 127 to 138° C.; 127 to 135° C.; 130 to 200° C.; 130 to 190° C.; 130 to 180° C.; 130 to 170° C.; 130 to 160° C.; 130 to 155° C.; 130 to 150° C.; 130 to 145° C.; 130 to 140° C.; 130 to 138° C.; 130 to 135° C.; 135 to 200° C.; 135 to 190° C.; 135 to 180° C.; 135 to 170° C.; 135 to 160° C.; 135 to 155° C.; 135 to 150° C.; 135 to 145° C.; 135 to 140° C.; 140 to 200° C.; 140 to 190° C.; 140 to 180° C.; 140 to 170° C.; 140 to 160° C.; 140 to 155° C.; 140 to 150° C.; 140 to 145° C.; 148 to 200° C.; 148 to 190° C.; 148 to 180° C.; 148 to 170° C.; 148 to 160° C.; 148 to 155° C.; 148 to 150° C.; 150 to 200° C.; 150 to 190° C.; 150 to 180° C.; 150 to 170° C.; 150 to 160; 155 to 190° C.; 155 to 180° C.; 155 to 170° C.; and 155 to 165° C.

For certain embodiments, the polyesters may exhibit at least one of the following inherent viscosities as determined in 60/40 (wt/wt) phenol/tetrachloroethane at a concentration of 0.5 g/100 ml at 25° C.: 0.10 to 1.2 dL/g; 0.10 to 1.1 dL/g; 0.10 to 1 dL/g; 0.10 to less than 1 dL/g; 0.10 to 0.98 dL/g; 0.10 to 0.95 dL/g; 0.10 to 0.90 dL/g; 0.10 to 0.85 dL/g; 0.10 to 0.80 dL/g; 0.10 to 0.75 dL/g; 0.10 to less than 0.75 dL/g; 0.10 to 0.72 dL/g; 0.10 to 0.70 dL/g; 0.10 to less than 0.70 dL/g; 0.10 to 0.68 dL/g; 0.10 to less than 0.68 dL/g; 0.10 to 0.65 dL/g; 0.20 to 1.2 dL/g; 0.20 to 1.1 dL/g; 0.20 to 1 dL/g; 0.20 to less than 1 dL/g; 0.20 to 0.98 dL/g; 0.20 to 0.95 dL/g; 0.20 to 0.90 dL/g; 0.20 to 0.85 dL/g; 0.20 to 0.80 dL/g; 0.20 to 0.75 dL/g; 0.20 to less than 0.75 dL/g; 0.20 to 0.72 dL/g; 0.20 to 0.70 dL/g; 0.20 to less than 0.70 dL/g; 0.20 to 0.68 dL/g; 0.20 to less than 0.68 dL/g; 0.20 to 0.65 dL/g; 0.35 to 1.2 dL/g; 0.35 to 1.1 dL/g; 0.35 to 1 dL/g; 0.35 to less than 1 dL/g; 0.35 to 0.98 dL/g; 0.35 to 0.95 dL/g; 0.35 to 0.90 dL/g; 0.35 to 0.85 dL/g; 0.35 to 0.80 dL/g; 0.35 to 0.75 dL/g; 0.35 to less than 0.75 dL/g; 0.35 to 0.72 dL/g; 0.35 to 0.70 dL/g; 0.35 to less than 0.70 dL/g; 0.35 to 0.68 dL/g; 0.35 to less than 0.68 dL/g; 0.35 to 0.65 dL/g; 0.40 to 1.2 dL/g; 0.40 to 1.1 dL/g; 0.40 to 1 dL/g; 0.40 to less than 1 dL/g; 0.40 to 0.98 dL/g; 0.40 to 0.95 dL/g; 0.40 to 0.90 dL/g; 0.40 to 0.85 dL/g; 0.40 to 0.80 dL/g; 0.40 to 0.75 dL/g; 0.40 to less than 0.75 dL/g; 0.40 to 0.72 dL/g; 0.40 to 0.70 dL/g; 0.40 to less than 0.70 dL/g; 0.40 to 0.68 dL/g; 0.40 to less than 0.68 dL/g; 0.40 to 0.65 dL/g; greater than 0.42 to 1.2 dL/g; greater than 0.42 to 1.1 dL/g; greater than 0.42 to 1 dL/g; greater than 0.42 to less than 1 dL/g; greater than 0.42 to 0.98 dL/g; greater than 0.42 to 0.95 dL/g; greater than 0.42 to 0.90 dL/g; greater than 0.42 to 0.85 dL/g; greater than 0.42 to 0.80 dL/g; greater than 0.42 to 0.75 dL/g; greater than 0.42 to less than 0.75 dL/g; greater than 0.42 to 0.72 dL/g; greater than 0.42 to less than 0.70 dL/g; greater than 0.42 to 0.68 dL/g; greater than 0.42 to less than 0.68 dL/g; and greater than 0.42 to 0.65 dL/g.

For certain embodiments, the polyesters may exhibit at least one of the following inherent viscosities as determined in 60/40 (wt/wt) phenol/tetrachloroethane at a concentration of 0.5 g/100 ml at 25° C.: 0.45 to 1.2 dL/g; 0.45 to 1.1 dL/g; 0.45 to 1 dL/g; 0.45 to 0.98 dL/g; 0.45 to 0.95 dL/g; 0.45 to 0.90 dL/g; 0.45 to 0.85 dL/g; 0.45 to 0.80 dL/g; 0.45 to 0.75 dL/g; 0.45 to less than 0.75 dL/g; 0.45 to 0.72 dL/g; 0.45 to 0.70 dL/g; 0.45 to less than 0.70 dL/g; 0.45 to 0.68 dL/g; 0.45 to less than 0.68 dL/g; 0.45 to 0.65 dL/g; 0.50 to 1.2 dL/g; 0.50 to 1.1 dL/g; 0.50 to 1 dL/g; 0.50 to less than 1 dL/g; 0.50 to 0.98 dL/g; 0.50 to 0.95 dL/g; 0.50 to 0.90 dL/g; 0.50 to 0.85 dL/g; 0.50 to 0.80 dL/g; 0.50 to 0.75 dL/g; 0.50 to less than 0.75 dL/g; 0.50 to 0.72 dL/g; 0.50 to 0.70 dL/g; 0.50 to less than 0.70 dL/g; 0.50 to 0.68 dL/g; 0.50 to less than 0.68 dL/g; 0.50 to 0.65 dL/g; 0.55 to 1.2 dL/g; 0.55 to 1.1 dL/g; 0.55 to 1 dL/g; 0.55 to less than 1 dL/g; 0.55 to 0.98 dL/g; 0.55 to 0.95 dL/g; 0.55 to 0.90 dL/g; 0.55 to 0.85 dL/g; 0.55 to 0.80 dL/g; 0.55 to 0.75 dL/g; 0.55 to less than 0.75 dL/g; 0.55 to 0.72 dL/g; 0.55 to 0.70 dL/g; 0.55 to less than 0.70 dL/g; 0.55 to 0.68 dL/g; 0.55 to less than 0.68 dL/g; 0.55 to 0.65 dL/g; 0.58 to 1.2 dL/g; 0.58 to 1.1 dL/g; 0.58 to 1 dL/g; 0.58 to less than 1 dL/g; 0.58 to 0.98 dL/g; 0.58 to 0.95 dL/g; 0.58 to 0.90 dL/g; 0.58 to 0.85 dL/g; 0.58 to 0.80 dL/g; 0.58 to 0.75 dL/g; 0.58 to less than 0.75 dL/g; 0.58 to 0.72 dL/g; 0.58 to 0.70 dL/g; 0.58 to less than 0.70 dL/g; 0.58 to 0.68 dL/g; 0.58 to less than 0.68 dL/g; 0.58 to 0.65 dL/g; 0.60 to 1.2 dL/g; 0.60 to 1.1 dL/g; 0.60 to 1 dL/g; 0.60 to less than 1 dL/g; 0.60 to 0.98 dL/g; 0.60 to 0.95 dL/g; 0.60 to 0.90 dL/g; 0.60 to 0.85 dL/g; 0.60 to 0.80 dL/g; 0.60 to 0.75 dL/g; 0.60 to less than 0.75 dL/g; 0.60 to 0.72 dL/g; 0.60 to 0.70 dL/g; 0.60 to less than 0.70 dL/g; 0.60 to 0.68 dL/g; 0.60 to less than 0.68 dL/g; 0.60 to 0.65 dL/g; 0.65 to 1.2 dL/g; 0.65 to 1.1 dL/g; 0.65 to 1 dL/g; 0.65 to less than 1 dL/g; 0.65 to 0.98 dL/g; 0.65 to 0.95 dL/g; 0.65 to 0.90 dL/g; 0.65 to 0.85 dL/g; 0.65 to 0.80 dL/g; 0.65 to 0.75 dL/g; 0.65 to less than 0.75 dL/g; 0.65 to 0.72 dL/g; 0.65 to 0.70 dL/g; 0.65 to less than 0.70 dL/g; 0.68 to 1.2 dL/g; 0.68 to 1.1 dL/g; 0.68 to 1 dL/g; 0.68 to less than 1 dL/g; 0.68 to 0.98 dL/g; 0.68 to 0.95 dL/g; 0.68 to 0.90 dL/g; 0.68 to 0.85 dL/g; 0.68 to 0.80 dL/g; 0.68 to 0.75 dL/g; 0.68 to less than 0.75 dL/g; 0.68 to 0.72 dL/g; greater than 0.76 dug to 1.2 dL/g; greater than 0.76 dL/g to 1.1 dL/g; greater than 0.76 dL/g to 1 dL/g; greater than 0.76 dL/g to less than 1 dL/g; greater than 0.76 dL/g to 0.98 dL/g; greater than 0.76 dL/g to 0.95 dL/g; greater than 0.76 dL/g to 0.90 dL/g; greater than 0.80 dL/g to 1.2 dL/g; greater than 0.80 dL/g to 1.1 dL/g; greater than 0.80 dL/g to 1 dL/g; greater than 0.80 dL/g to less than 1 dL/g; greater than 0.80 dL/g to 1.2 dL/g; greater than 0.80 dL/g to 0.98 dL/g; greater than 0.80 dL/g to 0.95 dL/g; greater than 0.80 dL/g to 0.90 dL/g.

In certain embodiments, it is contemplated that the polyester compositions can possess at least one of the inherent viscosity ranges described herein and at least one of the monomer ranges for the compositions described herein unless otherwise stated. It is also contemplated that the polyester compositions can possess at least one of the Tg ranges described herein and at least one of the monomer ranges for the compositions described herein unless otherwise stated. It is also contemplated that the polyester compositions can possess at least one of the Tg ranges described herein, at least one of the inherent viscosity ranges described herein, and at least one of the monomer ranges for the compositions described herein unless otherwise stated.

In embodiments, the molar ratio of cis/trans 2,2,4,4-tetramethyl-1,3-cyclobutanediol can vary from the pure form of each or mixtures thereof. In certain embodiments, the molar percentages for cis and/or trans 2,2,4,4,-tetramethyl-1,3-cyclobutanediol are greater than 50 mole % cis and less than 50 mole % trans; or greater than 55 mole % cis and less than 45 mole % trans; or 30 to 70 mole % cis and 70 to 30% trans; or 40 to 60 mole % cis and 60 to 40 mole % trans; or 50 to 70 mole % trans and 50 to 30% cis or 50 to 70 mole % cis and 50 to 30% trans; or 60 to 70 mole % cis and 30 to 40 mole % trans; or greater than 70 mole cis and less than 30 mole % trans; wherein the total sum of the mole percentages for cis- and trans-2,2,4,4-tetramethyl-1,3-cyclobutanediol is equal to 100 mole %. The molar ratio of cis/trans 1,4-cyclohexandimethanol can vary within the range of 50/50 to 0/100, such as between 40/60 to 20/80.

In certain embodiments, terephthalic acid or an ester thereof, such as, for example, dimethyl terephthalate, or a mixture of terephthalic acid and an ester thereof, makes up most, or all, of the dicarboxylic acid component used to form the polyesters. In certain embodiments, terephthalic acid residues can make up a portion or all of the dicarboxylic acid component used to form the polyester at a concentration of at least 70 mole %, such as at least 80 mole %, at least 90 mole %, at least 95 mole %, at least 99 mole %, or 100 mole %. In certain embodiments, higher amounts of terephthalic acid can be used to produce a higher impact strength polyester. In one embodiment, dimethyl terephthalate is part or all of the dicarboxylic acid component used to make the polyesters useful in the present invention. For the purposes of this disclosure, reference to residues of "terephthalic acid" and "dimethyl terephthalate" are used interchangeably herein. For example, reference to polymer residues of terephthalic acid (TPA) also includes polymer residues derived from dimethyl terephthalate (DMT). In all embodiments, ranges of from 70 to 100 mole %; or 80 to 100 mole %; or 90 to 100 mole %; or 99 to 100 mole %; or 100 mole % terephthalic acid and/or dimethyl terephthalate and/or mixtures thereof may be used.

In addition to terephthalic acid, in certain embodiments the dicarboxylic acid component of the polyester can comprise up to 30 mole %, up to 20 mole %, up to 10 mole %, up to 5 mole %, or up to 1 mole % of one or more modifying aromatic dicarboxylic acids. Yet another embodiment contains 0 mole % modifying aromatic dicarboxylic acids. Thus, if present, it is contemplated that the amount of one or more modifying aromatic dicarboxylic acids can range from any of these preceding endpoint values including, for example, from 0.01 to 30 mole %, 0.01 to 20 mole %, from 0.01 to 10 mole %, from 0.01 to 5 mole % and from 0.01 to 1 mole. In one embodiment, modifying aromatic dicarboxylic acids that may be used include but are not limited to those having up to 20 carbon atoms, and which can be linear, para-oriented, or symmetrical. Examples of modifying aromatic dicarboxylic acids which may be used include, but are not limited to, isophthalic acid, 4,4'-biphenyldicarboxylic acid, 1,4-, 1,5-, 2,6-, 2,7-naphthalenedicarboxylic acid, and trans-4,4'-stilbenedicarboxylic acid, and esters thereof. In one embodiment, the modifying aromatic dicarboxylic acid is isophthalic acid.

In embodiments, the carboxylic acid component of the polyesters can be further modified with up to 10 mole %, such as up to 5 mole % or up to 1 mole % of one or more aliphatic dicarboxylic acids containing 2-16 carbon atoms, such as, for example, malonic, succinic, glutaric, adipic, pimelic, suberic, azelaic and dodecanedioic dicarboxylic acids. Certain embodiments can also comprise 0.01 or more mole %, such as 0.1 or more mole %, 1 or more mole %, 5 or more mole %, or 10 or more mole % of one or more modifying aliphatic dicarboxylic acids. Yet another embodiment contains 0 mole % modifying aliphatic dicarboxylic acids. Thus, if present, it is contemplated that the amount of one or more modifying aliphatic dicarboxylic acids can range from any of these preceding endpoint values including, for example, from 0.01 to 10 mole % and from 0.1 to 10 mole %. The total mole % of the dicarboxylic acid component is 100 mole %.

Esters of terephthalic acid and the other modifying dicarboxylic acids or their corresponding esters and/or salts may be used instead of the dicarboxylic acids. Suitable examples of dicarboxylic acid esters include, but are not limited to, the dimethyl, diethyl, dipropyl, diisopropyl, dibutyl, and diphenyl esters. In one embodiment, the esters are chosen from at least one of the following: methyl, ethyl, propyl, isopropyl, and phenyl esters.

In embodiments for polyesters containing CHDM, the 1,4-cyclohexanedimethanol may be cis, trans, or a mixture thereof, for example a cis/trans ratio of 60:40 to 40:60. In one embodiment, the trans-1,4-cyclohexanedimethanol can be present in an amount of 60 to 80 mole %.

In embodiments, the polyester(s) can be linear or branched. In embodiments, the polycarbonate (if included) can also be linear or branched. In certain embodiments, a branching monomer or agent may be added prior to and/or during and/or after the polymerization of the polycarbonate.

Examples of branching monomers include, but are not limited to, multifunctional acids or multifunctional alcohols such as trimellitic acid, trimellitic anhydride, pyromellitic dianhydride, trimethylolpropane, glycerol, pentaerythritol, citric acid, tartaric acid, 3-hydroxyglutaric acid and the like. In one embodiment, the branching monomer residues can comprise 0.1 to 0.7 mole percent of one or more residues chosen from at least one of the following: trimellitic anhydride, pyromellitic dianhydride, glycerol, sorbitol, 1,2,6-hexanetriol, pentaerythritol, trimethylolethane, and/or trimesic acid. The branching monomer may be added to the polyester reaction mixture or blended with the polyester in the form of a concentrate as described, for example, in U.S. Pat. Nos. 5,654,347 and 5,696,176, whose disclosure regarding branching monomers is incorporated herein by reference.

The glass transition temperature (Tg) of the polyesters can be determined using a TA DSC 2920 from Thermal Analyst Instrument at a scan rate of 20° C./min.

Long crystallization half-times (e.g., greater than 5 minutes) at 170° C. exhibited by certain of the polyesters, can be beneficial for production of certain injection molded, compression molded, and solution casted articles. The polyesters can be amorphous or semi-crystalline. In one aspect, certain polyesters can have relatively low crystallinity. Certain polyesters can thus have a substantially amorphous morphology, meaning that the polyesters comprise substantially unordered regions of polymer.

In one embodiment, an "amorphous" polyester can have a crystallization half-time of greater than 5 minutes at 170° C. or greater than 10 minutes at 170° C. or greater than 50 minutes at 170° C. or greater than 100 minutes at 170° C. In one embodiment, of the invention, the crystallization half-times are greater than 1,000 minutes at 170° C. In another embodiment of the invention, the crystallization half-times of the polyesters useful in the invention are greater than 10,000 minutes at 170° C. The crystallization half time of the polyester, as used herein, may be measured using methods well-known to persons of skill in the art. For example, the crystallization half time of the polyester, $t_{1/2}$, can be determined by measuring the light transmission of a sample via a laser and photo detector as a function of time on a temperature controlled hot stage. This measurement can be done by exposing the polymers to a temperature, $T_{max}$, and then cooling it to the desired temperature. The sample can then be held at the desired temperature by a hot stage while transmission measurements are made as a function of time. Initially, the sample can be visually clear with high light transmission and becomes opaque as the sample crystallizes. The crystallization half-time is the time at which the light transmission is halfway between the initial transmission and the final transmission. $T_{max}$ is defined as the temperature required to melt the crystalline domains of the sample (if crystalline domains are present). The sample can be heated to Tmax to condition the sample prior to crystallization half time measurement. The absolute Tmax temperature is different for each composition. For example, PCT can be heated to some temperature greater than 290° C. to melt the crystalline domains.

In embodiments, certain polyesters are visually clear. The term "visually clear" is defined herein as an appreciable absence of cloudiness, haziness, and/or muddiness, when inspected visually. In one embodiment, when the polyesters are blended with polycarbonate, including bisphenol A polycarbonates, the blends can be visually clear. In embodiments, the polyesters can possess one or more of the properties described herein. In embodiments, the polyesters can have a yellowness index (ASTM D-1925) of less than 50, such as less than 20.

In embodiments, the polyesters and/or the polyester compositions of the invention, with or without toners, can have color values L*, a* and b*, which can be determined using a Hunter Lab Ultrascan Spectra Colorimeter manufactured by Hunter Associates Lab Inc., Reston, Va. The color determinations are averages of values measured on either pellets of the polyesters or plaques or other items injection molded or extruded from them They are determined by the L*a*b* color system of the CIE (International Commission on Illumination) (translated), wherein L* represents the lightness coordinate, a* represents the red/green coordinate, and b* represents the yellow/blue coordinate. In certain embodiments, the b* values for the polyesters useful in the invention can be from −10 to less than 10 and the L* values can be from 50 to 90. In other embodiments, the b* values for the polyesters useful in the invention can be present in one of the following ranges: −10 to 9; −10 to 8; −10 to 7; −10 to 6; −10 to 5; −10 to 4; −10 to 3; −10 to 2; from −5 to 9; −5 to 8; −5 to 7; −5 to 6; −5 to 5; −5 to 4; −5 to 3; −5 to 2; 0 to 9; 0 to 8; 0 to 7; 0 to 6; 0 to 5; 0 to 4; 0 to 3; 0 to 2; 1 to 10; 1 to 9; 1 to 8; 1 to 7; 1 to 6; 1 to 5; 1 to 4; 1 to 3; and 1 to 2. In other embodiments, the L* value for the polyesters useful in the invention can be present in one of the following ranges: 50 to 60; 50 to 70; 50 to 80; 50 to 90; 60 to 70; 60 to 80; 60 to 90; 70 to 80; 79 to 90.

The polyester portion of the polyester compositions can be made by processes known from the literature such as, for example, by processes in homogenous solution, by transesterification processes in the melt, and by two phase interfacial processes. Suitable methods include those disclosed in U.S. Published Application 2006/0287484, the contents of which is incorporated herein by reference.

In embodiments, the polyester can be prepared by a method that includes reacting one or more dicarboxylic acids (or derivative thereof) with one or more glycols under conditions to provide the polyester including, but are not limited to, the steps of reacting one or more dicarboxylic acids (or derivative thereof) with one or more glycols at a temperature of 100° C. to 315° C. at a pressure of 0.1 to 760 mm Hg for a time sufficient to form a polyester. See U.S. Pat. No. 3,772,405 for methods of producing polyesters, the disclosure regarding such methods is hereby incorporated herein by reference.

In embodiments, the polyester composition can be a polymer blend, wherein the blend comprises, consists of, or consists essentially of: (a) 5 to 95 wt % of at least one of the polyesters described herein; and (b) 5 to 95 wt % of at least one polymeric component. Suitable examples of polymeric components include, but are not limited to, nylon, polyesters different from those described herein, polyamides such as ZYTEL® from DuPont; polystyrene, polystyrene copolymers, styrene acrylonitrile copolymers, acrylonitrile butadiene styrene copolymers, poly(methylmethacrylate), acrylic copolymers, poly(ether-imides) such as ULTEM® (a poly (ether-imide) from General Electric); polyphenylene oxides such as poly(2,6-dimethylphenylene oxide) or poly(phenylene oxide)/polystyrene blends such as NORYL 1000® (a blend of poly(2,6-dimethylphenylene oxide) and polystyrene resins from General Electric); polyphenylene sulfides; polyphenylene sulfide/sulfones; poly(ester-carbonates); polycarbonates such as LEXAN® (a polycarbonate from General Electric); polysulfones; polysulfone ethers; and poly(ether-ketones) of aromatic dihydroxy compounds; or mixtures of any of the other foregoing polymers. The blends can be prepared by conventional processing techniques known in the art, such as melt blending or solution blending. In one embodiment, the polycarbonate is not present in the polyester composition. If polycarbonate is used in a blend in the polyester compositions useful in the invention, the blends can be visually clear. However, the polyester compositions useful in the invention also contemplate the exclusion of polycarbonate as well as the inclusion of polycarbonate.

In addition, the polyester compositions and the polymer blend compositions may also contain from 0.01 to 25% by weight of the overall composition common additives such as colorants, dyes, mold release agents, flame retardants, plasticizers, nucleating agents, stabilizers, including but not limited to, UV stabilizers, thermal stabilizers and/or reaction products thereof, fillers, and impact modifiers. For example, UV additives can be incorporated into the articles through addition to the bulk or in a hard coat. Examples of typical commercially available impact modifiers well known in the art and useful in this invention include, but are not limited to, ethylene/propylene terpolymers; functionalized polyolefins, such as those containing methyl acrylate and/or glycidyl methacrylate; styrene-based block copolymeric impact modifiers, and various acrylic core/shell type impact modifiers. Residues of such additives are also contemplated as part of the polyester composition. In embodiments, the bowl surface, e.g., the polyester material surface, can include one or more coatings or treatments to improve scratch resistance. In embodiments, the scratch resistance can be improved via a hard coating chosen from acrylic, silicon, silicone, siloxane, epoxy, or blend (e.g., a siloxane modified PMMA) coating on the polyester surface in need of improved scratch resistance; and/or via a bulk additive, e.g., chosen from silica fillers, amorphous silica with silane coupling, crystalline silica with silane coupling, fluorinated additives, lubricants, or combinations thereof.

In embodiments, the polyesters can comprise at least one chain extender. Suitable chain extenders include, but are not limited to, multifunctional (including, but not limited to, bifunctional) isocyanates, multifunctional epoxides, including for example, epoxylated novolacs, and phenoxy resins. In certain embodiments, chain extenders may be added at the end of the polymerization process or after the polymerization process. If added after the polymerization process, chain extenders can be incorporated by compounding or by addition during conversion processes such as injection molding or extrusion. The amount of chain extender used can vary depending on the specific monomer composition used and the physical properties desired but is generally from 0.1 percent by weight to 10 percent by weight, such as from 0.1 to 5 percent by weight, based on the total weigh of the polyester.

Thermal stabilizers are compounds that stabilize polyesters during polyester manufacture and/or post polymerization, including, but not limited to, phosphorous compounds, including, but not limited to, phosphoric acid, phosphorous acid, phosphonic acid, phosphinic acid, phosphonous acid, and various esters and salts thereof. The esters can be alkyl, branched alkyl, substituted alkyl, difunctional alkyl, alkyl ethers, aryl, and substituted aryl. In one embodiment, the number of ester groups present in the particular phosphorous compound can vary from zero up to the maximum allowable based on the number of hydroxyl groups present on the thermal stabilizer used. The term "thermal stabilizer" is intended to include the reaction product(s) thereof. The term "reaction product" as used in connection with the thermal stabilizers of the invention refers to any product of a polycondensation or esterification reaction between the thermal stabilizer and any of the monomers used in making the polyester as well as the product of a polycondensation or esterification reaction between the catalyst and any other type of additive. In embodiments, these can be present in the polyester compositions.

In embodiments, reinforcing materials may be useful in the polyester compositions. The reinforcing materials may include, but are not limited to, carbon filaments, silicates, mica, clay, talc, titanium dioxide, Wollastonite, glass flakes, glass beads and fibers, and polymeric fibers and combinations thereof. In one embodiment, the reinforcing materials are glass, such as, fibrous glass filaments, mixtures of glass and talc, glass and mica, and glass and polymeric fibers.

In embodiments, the plastic bowl has a wall thickness in a range from 2 to 10 mm, or 2 to 8 mm, or 2 to 6 mm, or 2 to 5 mm, or 2 to 4 mm. In embodiments, the open end of the plastic bowl is substantially circular having an outside diameter in a range from 25 to 55 cm, or 30 to 50 cm, or 30 to 45 cm, or 30 to 40 cm, or 35 to 55 cm, or 35 to 50 cm, or 35 to 45 cm, or 40 to 55 cm, or 40 to 50 cm. In embodiments, the diameter can be selected to match standard washer sizes used in the industry. In embodiments, the plastic bowl defines an inside of the bowl (measured from the open end to the closed end) having a volume of about 1000 to 7000 cm3, or 1500 to 6500 cm3, or 2000 to 6000 cm3, or 2500 to 5800 cm3, or 2800 to 6000 cm3, or 2800 to 5800 cm3, or 3000 to 6000 cm3, or 3000 to 5800 cm3, or 3500 to 6000 cm3, or 3500 to 5800 cm3, or 4000 to 6000 cm3, or 4000 to 5800 cm3, or 4400 to 6000 cm3, or 4400 to 5800 cm3, or 4400 to 5700 cm3. In embodiments, the ring-shaped outer circumferential surface of the bowl has a length of about 1 to 5 cm, or 1 to 4 cm, or 1 to 3 cm, or 2 to 5 cm, or 2 to 4 cm, or 2 to 3 cm, or 2.5 to 5 cm, or 2.5 to 4 cm, or 2.5 to 3.5 cm, or 3 to 5 cm, or 3 to 4 cm, or 3.5 to 5 cm, or 3.5 to 4.5 cm, or 4 to 5 cm, measured perpendicularly from the open-end edge of the bowl on the outside of the bowl.

Certain aspects of the above-described bowl design enable the bowl to be produced from a substantially BPA-free material, while still maintaining the desired strength for the bowl. Thus, in one embodiment, the bowl of the present invention can be made from materials other than BPA-based polycarbonates. As used herein, "substantially BPA-free" refers to an article or material that contains less than 1, 0.5, 0.1, 0.05, or 0.01 weight percent of BPA-based polycarbonate.

In one embodiment, the bowl can be at least partly formed from a substantially BPA-free synthetic polymeric material. The synthetic polymeric material can make up at least 50, 75, 90, 95, or 100 percent of the total weight of the bowl. In one embodiment, the bowl can be formed by molding the synthetic polymeric material into the desired configuration discussed in detail above. In embodiments, the molding method can be chosen from injection molding, multiple shot (e.g., 2 shot) injection molding, thermoforming (e.g., vacuum forming), rotational molding, injection blow molding, or stretch blow molding. In embodiments, the bowl is formed from 2 or more materials that are different, e.g., 2 shot injection molding with polyester and ABS plastics, as discussed herein.

The synthetic polymeric material used to make the bowl (or at least a portion thereof as discussed herein) can have a flexural modulus of at least 100,000, 150,000, 200,000, or 215,000 psi and/or not more than 350,000, 300,000, 250,000, or 230,000 psi as measured by ASTM D790. The synthetic polymeric material can have a flexural yield strength of at least 5,000, 7,000, or 8,500 psi and/or not more than 12,000, 10,000, or 9,500 psi as measured by ASTM D790. The synthetic polymeric material can have a tensile strength at yield of at least 4,000, 5,000, 6,000, 6,500, or 7,250 psi and/or not more than 10,000, 9,000, 8000, or 7,000 psi as measured by ASTM D638. The synthetic polymeric material can have an impact strength of at least 8, 12, 14, or 15 ft-lb/in as measured by ASTM D256. The synthetic polymeric material can have a glass transition temperature of at least 90, 100, or 110 and/or not more than 140, 130, or 120° C. as measured by ASTM D3418. The synthetic polymeric material can have a melt viscosity of at least 1,000, 2,000, or 3,000 poise and/or not more than 20,000, 15,000, 12,000, 10,000, 8,000, or 6,000 poise as measured at 1 radian per second on a rotary melt rheometer at 290° C. The synthetic polymeric material can have an inherent viscosity of at least 0.4, 0.5, 0.6, 0.65, or 0.7 and/or not more than 1.0, 0.9, 0.8, or 0.75, as determined in 60/40 (wt/wt) phenol/tetrachloroethane at a concentration of 0.5 grams per 100 milliliters at 25° C. The synthetic polymeric material can have a transmittance of at least 75, 85, or 88 percent as measured by ASTM D1003. The synthetic polymeric material can have a haze of less than 5, 3, or 1.5 percent as measured by ASTM D1003.

In embodiments, the bowl and/or door assembly (containing or incorporating the bowl) will pass a 6.8 J impact test in accordance with UL2157 and UL2158.

According to certain embodiments of the present invention, the synthetic polymeric material can be a polyester or copolyester. In one embodiment, the synthetic polymeric material can comprise glycol units derived from 2,2,4,4-tetramethyl-1,3-cyclobutanediol and/or 1,4-cyclohexanedimethanol. In a more specific example, the synthetic polymeric material can be a polyester having a dicarboxylic acid component and a glycol component, where the dicarboxylic component comprises at least 70, 80, 90, 95, or 100 mole percent of terephthalic acid residues and the glycol component comprises at least 10, 15, 20, 25 mole percent and/or not more than 80, 60, 40, 35, or 30 mole percent of 2,2,4,4-tetramethyl-1,3-cyclobutanediol and at least 20, 40, 60, 65, or 70 mole percent and/or not more than 90, 85, 80, or 75 mole percent of 2,2,4,4-tetramethyl-1,3-cyclobutanediol.

In embodiments, the synthetic polymeric material can comprise a copolyester chosen from one or more of the following grades: TRITAN™ copolyester TX1000, TX1001, TX1500, TX1501, TX2000 or TX2001, available from Eastman Chemical Company of Kingsport, TN.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A washing machine door assembly comprising:

an outer door frame including a ring-shaped member with an outer circumferential surface that defines an opening;

a bowl having an open end and a closed end defining an inside and an outside of the bowl and an inner circumferential surface on the inside of the bowl adjacent to and disposed around the perimeter of the open end of the bowl;

wherein the inner circumferential surface of the bowl and the outer circumferential surface of the ring-shaped member are fixedly engaged by one or more engagement features that comprise(s) at least one pair of mating engagement components;

wherein the bowl comprises a first plastic composition that comprises a copolyester; and wherein the outer door frame comprises a second plastic composition that is the same or different than the first plastic composition.

2. The assembly according to claim 1, wherein the first plastic composition comprises a copolyester, said copolyester comprising: a dicarboxylic acid component and a glycol component, wherein said dicarboxylic acid component comprises at least 70 mole percent of terephthalic acid residues, wherein said glycol component comprises at least 10 mole percent and not more than 80 mole percent of 2,2,4,4-tetramethyl-1,3-cyclobutanediol residues, and wherein said glycol component comprises at least 20 mole percent and not more than 90 mole percent of 1,4-cyclohexanedimethanol residues.

3. The assembly according to claim 2, wherein the second plastic composition comprises an acrylonitrile butadiene styrene (ABS) thermoplastic polymer or polypropylene.

4. The assembly according to claim 1, wherein the inner circumferential surface of the bowl and the outer circumferential surface of the ring-shaped member are fixedly engaged by one or more engagement features that comprise (s) at least one pair of mating engagement components, wherein one of the components of the pair is integrally-formed in said bowl and the other component of the pair is integrally-formed in said outer door frame.

5. The assembly according to claim 4, wherein the inner circumferential surface of the bowl and the outer circumferential surface of the ring-shaped member are releasably fixedly engaged.

6. The assembly according to claim 5, wherein the pair of mating engagement components are configured to make a twist-lock connection.

7. The assembly according to claim 1, wherein the washing machine door assembly does not include an inner ring door frame.

8. The assembly according to claim 1, wherein the bowl is transparent and has a notched izod impact of at least 800 J/m measured according to ASTM D256 at 23° C. using a 3.2 mm thick bar and a glass transition temperature of at least 105° C. using DSC at a scan rate of 20° C./min according to ASTM D3418.

9. The assembly according to claim 1, wherein said bowl has a weight of at least 400 grams and not more than 1200 grams, wherein the inside of said bowl defines a volume of at least 2500 cm3 and not more than 6000 cm3.

10. The assembly according to claim 1, wherein said bowl has a drop impact resistance of at least 3 feet as measure by ASTM D 2463-95.

11. The assembly according to claim 1, wherein said copolyester makes up at least 50 percent of the total weight of said bowl.

12. The assembly according to claim 1, wherein said bowl comprises less than 1 weight percent of bisphenol A polycarbonate.

13. The assembly according to claim 1, wherein said first plastic composition has a flexural modulus of at least 100,000 psi and not more than 300,000 psi as measured by ASTM D790.

14. The assembly according to claim 1, wherein said bowl has a transmittance of at least 85 percent as measured by ASTM D1003, and wherein said bowl has a haze of less than 3 percent as measured by ASTM D1003.

* * * * *